US008011050B2

(12) United States Patent
Knopow

(10) Patent No.: US 8,011,050 B2
(45) Date of Patent: Sep. 6, 2011

(54) FABRIC SWEEPER

(75) Inventor: Jeremy F. Knopow, Burlington, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1146 days.

(21) Appl. No.: 11/450,315

(22) Filed: Jun. 10, 2006

(65) Prior Publication Data

US 2006/0265824 A1 Nov. 30, 2006

Related U.S. Application Data

(63) Continuation-in-part of application No. 11/141,099, filed on May 31, 2005, now Pat. No. 7,721,372, and a continuation-in-part of application No. 29/239,706, filed on Oct. 3, 2005, now Pat. No. Des. 547,954.

(51) Int. Cl.
*A47L 25/00* (2006.01)

(52) U.S. Cl. ..... 15/27; 15/39.5; 15/48; 15/221

(58) Field of Classification Search ..... 15/27, 39.5, 15/40, 41.1, 44, 48, 97.1, 98, 221
See application file for complete search history.

(56) References Cited

U.S. PATENT DOCUMENTS

| | | | | |
|---|---|---|---|---|
| 972,690 | A | 11/1910 | Goble | |
| 2,460,183 | A | 1/1949 | Mayer | |
| 2,651,803 | A | 9/1953 | Browne | |
| 3,319,278 | A * | 5/1967 | Frazer | 15/41.1 |
| 3,618,153 | A | 11/1971 | Coult | |
| 3,631,557 | A | 1/1972 | Leifheit et al. | |
| 3,651,529 | A | 3/1972 | Popeil et al. | |
| 3,747,152 | A | 7/1973 | Tsuruzawa | |
| 3,772,726 | A * | 11/1973 | Kupperman et al. | 15/48 |
| 3,842,459 | A | 10/1974 | Tsuruzawa et al. | |
| 3,900,911 | A | 8/1975 | Hayashi | |
| 4,080,683 | A | 3/1978 | Yi | |
| 4,462,134 | A * | 7/1984 | Wang | 15/98 |
| 4,464,804 | A | 8/1984 | Hopkins | |

(Continued)

FOREIGN PATENT DOCUMENTS

GB 1114881 5/1968

(Continued)

OTHER PUBLICATIONS

PCT/US2007/013270 International Search Report and Written Opinion dated Apr. 21, 2008.

(Continued)

*Primary Examiner* — Mark Spisich

(57) ABSTRACT

The present invention is a device (10) for use in cleaning a fabric surface (16) of dust, dirt, pet hair and other debris (20) present on the surface (16). The device (10) includes a pair of cleaning members or rollers (60, 61) disposed on an underside of the device (10) which can roll with respect to the device (10) and with respect to one another. The rollers (60, 61) are selectively contacted with one another such that each roller (60, 61) can assist in removing debris (20) picked up by the opposite roller (60, 61) and dispensing the debris (20) into a collection chamber (32) releasably positioned within a housing (11). The removal of the debris (20) from each roller (60, 61) is also facilitated by opposed edges of a central opening (58) in the housing (11) that contact the rollers (60, 61) and direct the debris (20) into the debris collection chamber (32).

20 Claims, 26 Drawing Sheets

U.S. PATENT DOCUMENTS

| | | | | |
|---|---|---|---|---|
| 4,596,059 | A * | 6/1986 | Lee | 15/98 |
| 4,742,594 | A * | 5/1988 | Chen | 15/98 |
| 4,765,012 | A | 8/1988 | Ueda | |
| 5,664,276 | A | 9/1997 | Arias | |
| 5,970,558 | A | 10/1999 | Canavan et al. | |
| 6,783,600 | B2 | 8/2004 | Tawara et al. | |
| 6,895,627 | B1 | 5/2005 | Lin | |
| 7,137,165 | B2 | 11/2006 | Shizuno et al. | |
| 2004/0143919 | A1 | 7/2004 | Wilder | |
| 2005/0079315 | A1 | 4/2005 | Seth et al. | |
| 2006/0265824 | A1 | 11/2006 | Knopow | |
| 2006/0277706 | A1 | 12/2006 | Clark et al. | |
| 2007/0202768 | A1 | 8/2007 | Haskett et al. | |
| 2007/0220691 | A1 | 9/2007 | McKay | |
| 2008/0040874 | A1 | 2/2008 | McKay | |
| 2008/0041416 | A1 | 2/2008 | Mathews et al. | |
| 2008/0052849 | A1 | 3/2008 | McKay | |
| 2008/0052854 | A1 | 3/2008 | McKay | |

FOREIGN PATENT DOCUMENTS

| | | | |
|---|---|---|---|
| GB | 2187377 | A | 9/1987 |
| GB | 2257620 | A | 1/1993 |
| JP | 63216506 | | 9/1988 |
| JP | 2026527 | | 1/1990 |
| JP | 8-25892 | | 1/1996 |
| JP | 11-178766 | * | 7/1999 |
| JP | 2001-258644 | * | 9/2001 |
| JP | 2004-329618 | * | 11/2004 |
| WO | WO2006/130216 | A1 | 12/2006 |
| WO | WO 2007/092038 | | 8/2007 |

OTHER PUBLICATIONS

Product Advertisement for Quick Cleaner sold by Petio Yamahisa, 4 pages, undated, partial translation provided.

Photograph (top and bottom) of Quick Cleaner Product, 2 pages, undated.

* cited by examiner

FABRIC SWEEPER

CROSS-REFERENCE TO RELATED APPLICATIONS

This application is a continuation-in-part of patent application Ser. No. 11/141,099, filed May 31, 2005, now U.S. Pat. No. 7,721,372 and of patent application Ser. No. 29/239,706, filed Oct. 3, 2005 now U.S. Pat. No. D547,954.

BACKGROUND OF THE INVENTION

1. Field of the Invention

The present invention relates to cleaning devices, and more specifically to a cleaning device for fabrics that is capable of picking up and retaining for disposal various debris located on a fabric surface. The present invention also relates to a cleaning kit having preferably a cleaning device and instructions for using the same.

2. Discussion of the Related Art

When cleaning fabric surfaces, often times mechanical vacuum cleaning devices are utilized in order to effectively remove dirt, dust, and other debris from the fabric surface. However, due to the often large and cumbersome construction of these types of mechanical vacuum fabric cleaning devices, these devices are often not suitable for use in certain situations where the fabric surface to be cleaned is relatively small, or is positioned in a difficult to access location. In addition, for various instances of spot cleaning certain fabric surfaces, a large mechanical cleaning device is often impractical for the particular cleaning task.

Therefore, in order to provide a lightweight cleaning device that can be utilized as an alternative to larger mechanical vacuum cleaning devices for these types of situations, various types of alternative cleaning devices and brushes have been developed. For example, Tsuruzawa U.S. Pat. No. 3,747,152 discloses a cleaning brush with dust removing and collection means. The device includes a rotatable or slidable brush that is mounted to a housing that can be grasped by an individual to move the brush across a surface to be cleaned. The movable brush is formed with a number of bristles which are oriented generally oppositely to bristles on a pair of brush members disposed on the housing surrounding the brush. The bristles on the movable brush pick up dirt from the surface by contacting the dirt as the brush is moved across the surface. The bristles then rotate into engagement with the bristles on the brush members in the housing to dislodge the dirt from the movable brush. The dirt and dust dislodged by the brush members is then collected within the movable brush opposite the bristles for later removal through an opening in the housing to which the movable brush is mounted.

However, this device has certain shortcomings in that the ability of the brush to effectively retain any dirt, dust or other debris picked up by the movable brush is determined by the contact of the bristles on the brush with the bristles of the brush members. Because the movable brush necessarily has to move into contact with the brush members from the exterior of the device, the brush can dislodge the dirt, dust and other debris from the movable brush before the dirt is located within the brush housing. Furthermore, for that component of the dirt, dust and other debris that is actually contained within the housing as a result of the proper operation of the device, the debris must be dispensed by inverting the device and shaking the housing such that the debris moves through an opening in the housing, which is a highly inefficient manner to remove the dirt from the device.

Therefore, it is desirable to develop a lightweight, manually operable fabric surface cleaning or sweeping device that engages dirt, dust and other debris picked up off of a fabric surface in a manner which more effectively removes the debris from the surface and deposits this debris within a collection chamber positioned in the device. Further, it is also desirable to develop a fabric sweeper cleaning device in which the dust or debris collected by the device can be more easily dispensed of using the separate collection chamber.

SUMMARY AND OBJECTS OF THE INVENTION

According to a primary aspect of the present invention, a fabric cleaning and/or sweeping device is provided with a housing that preferably includes at least one fabric cleaning member. In one embodiment, a pair of movable cleaning members are secured within a recess in the housing such that each member is engageable with the fabric to be cleaned and with the opposed fabric cleaning member. The movable cleaning members rotate with respect to the housing as the cleaning device is moved over the fabric surface, and pick up any dust, dirt or other debris on the fabric surface. The movable cleaning members are secured within the housing in a manner which enables the members to rotate independently of one another, but also that the cleaning members selectively come into contact with one another. When the cleaning members contact one another, the members effectively act as a cleaning mechanism for one another, urging the dust, dirt and other debris off of the opposite member and into a collection chamber for the device. The members can easily pick up dust, dirt and other debris from the fabric surface due to the construction of the cleaning members which include an outer surface formed of a material that readily attracts pet hair, crumbs, dust, lint, allergens and other materials present on the fabric surface. The materials are also chosen to be somewhat flexible such that the material, in addition to being cleaned by the material positioned on the opposed rotatable member, can be further cleaned of the dirt, dust and other debris picked up by the material as a result of the contact of the material on each cleaning member with the housing.

According to another aspect of the present invention, the housing preferably includes a dirt collection chamber with an open lower end that is in communication with the space within which the rotatable members are positioned such that the dirt and dust picked up by the cleaning members is diverted through the housing into the collection chamber. In one embodiment, the chamber is preferably removably retained within the housing until such time as the chamber becomes filled with dirt, dust and other debris picked up by the cleaning members. The chamber can then be removed, emptied and/or replaced in order to ready the device for additional cleaning.

According to still another aspect of the present invention, the housing within which the cleaning members and the collection chamber are positioned is designed to enable easy handling and use by an individual to clean a fabric surface. Additionally, the housing is formed with a minimum of parts, which can each be formed of lightweight materials that are relatively low cost and easy to manufacture into the housing components.

In yet another preferred embodiment, the invention is a cleaning kit comprising: a fabric cleaning and/or sweeping device and instructions on its use.

Numerous other aspects, features and advantages of the present invention will be made apparent from the following detail description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
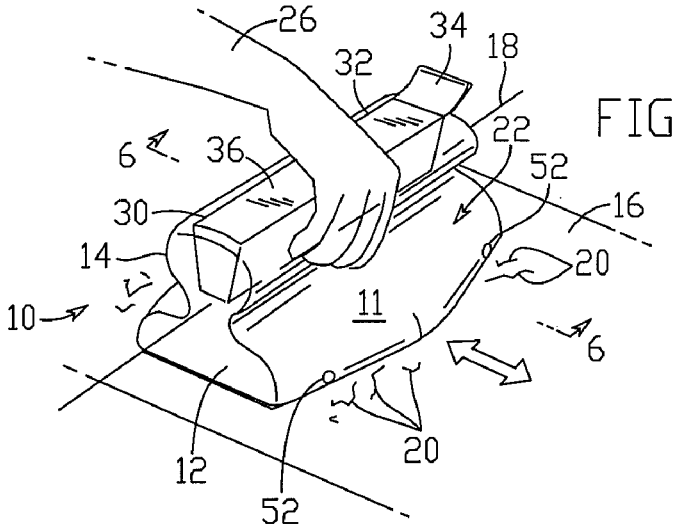
FIG. 1 is an isometric view of one embodiment of a fabric sweeper cleaning device of the present invention.
Figure 2:
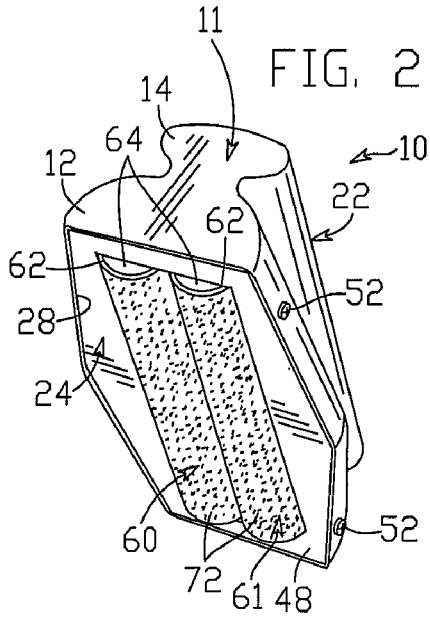
FIG. 2 is an isometric view illustrating the cleaning members of the device of FIG. 1.
Figure 3:
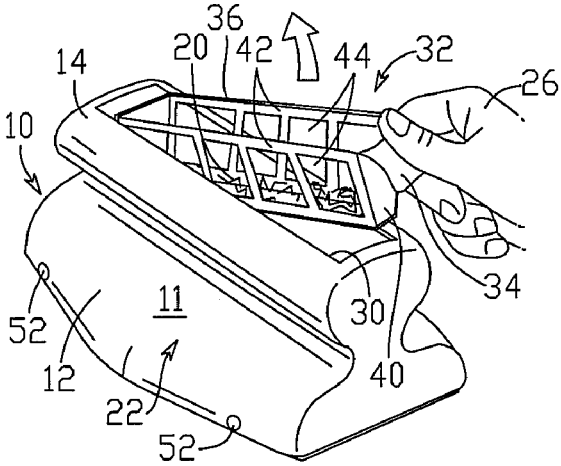
FIG. 3 is an isometric view illustrating the removal of a collection chamber of the device of FIG. 1.

With reference now to the drawing figures in which like reference numerals designate like parts throughout the disclosure, a fabric cleaning or sweeping device constructed according to the present invention is indicated generally by the reference number 10 in FIG. 1. The fabric sweeper or device 10 preferably includes a housing 11 with a base portion 12 and a handle portion 14 extending upwardly from the base portion 12. When in use, the base portion 12 of the device 10 is positioned on a fabric surface 16 and moved in a direction generally perpendicularly to the long axis 18 of the device 10 in order to pick up debris 20 disposed on the fabric surface 16.

Referring now to FIGS. 1-6, the device 10 is formed with an outer housing 22 and an inner housing 24. Both the outer housing 22 and inner housing 24 are formed of a generally rigid material, that is also preferably lightweight, in order to enable the device 10 to be easily manipulated by an individual's hand 26, as best shown in FIG. 1. Most preferably, each housing 22 and 24 is constructed of a plastic material, such that the shape of the respective housings 22 and 24 can be easily modified as desired, and formed in a conventional plastic molding process, e.g., injection molding.

The outer housing 22 includes a lower opening 28 within which the inner housing 24 is located, and an upper opening 30 positioned generally opposite the lower opening 28. The upper opening 30 can have any desired shape, but is preferably rectangular in shape in order to accommodate a collection chamber or bin 32 therein. The bin 32 includes a handle 34 at one end to facilitate the removal of the bin 32 from within the upper opening 30 in the outer housing 22. The bin 32 is also formed of a generally lightweight material, such as a plastic material, and includes a wide, closed end 36 at the top of the bin 32, and a narrow open end 38 at the bottom of the bin 32. Inwardly tapering end walls 40 extend between the closed end 36 and open end 38 at each end of the bin 32, and are joined by sidewalls 42. The side walls 42 are integrally formed with the end walls 40 and include a number of open sections 44 spaced therealong. The open sections 44 allow an individual to view the interior of the bin 32 in order to determine how much debris 20 has been collected therein. The open sections 44 are preferably enclosed by a transparent material 46 that can extend from one side of the open end 38 over the adjacent side wall 42, over the top of the bin 32 to form the closed end 36, and down over the opposed side wall 42. In this embodiment, the transparent material 46 allows an individual to view the interior of the bin 32 regardless of whether the bin 32 is positioned within or removed at least partially from the upper opening 30 in the device 10. Additionally, to provide a more aesthetically pleasing appearance to the device 10, the closed end 36 of the bin 32 can be formed of material similar to the material forming the housing 22 to provide a more seamless appearance between the closed end 36 of the bin 32 and the handle portion 14 of the device 10.

Figure 4:
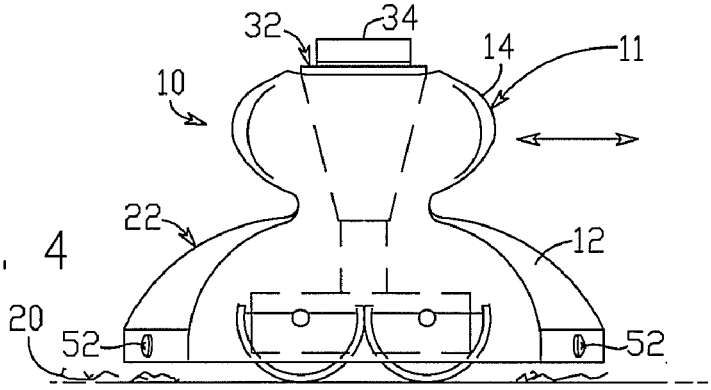
FIG. 4 is an end elevational view of the device of FIG. 1.
Figure 5:
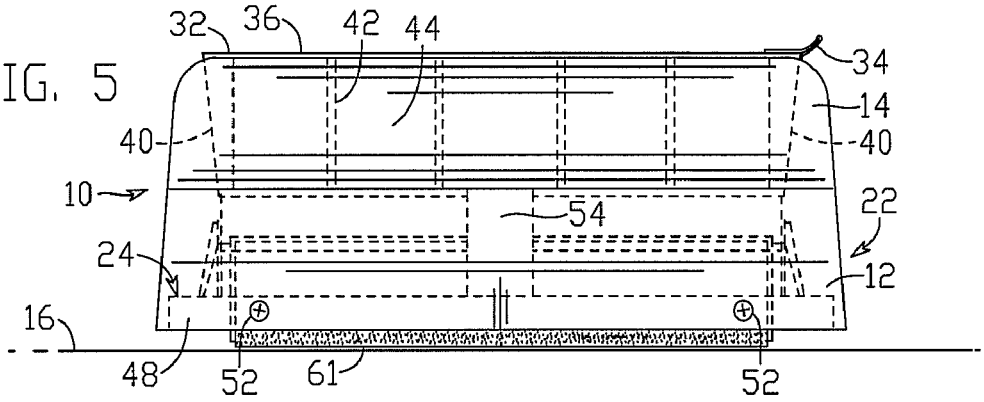
FIG. 5 is a side elevational view of the device of FIG. 1.
Figure 6:
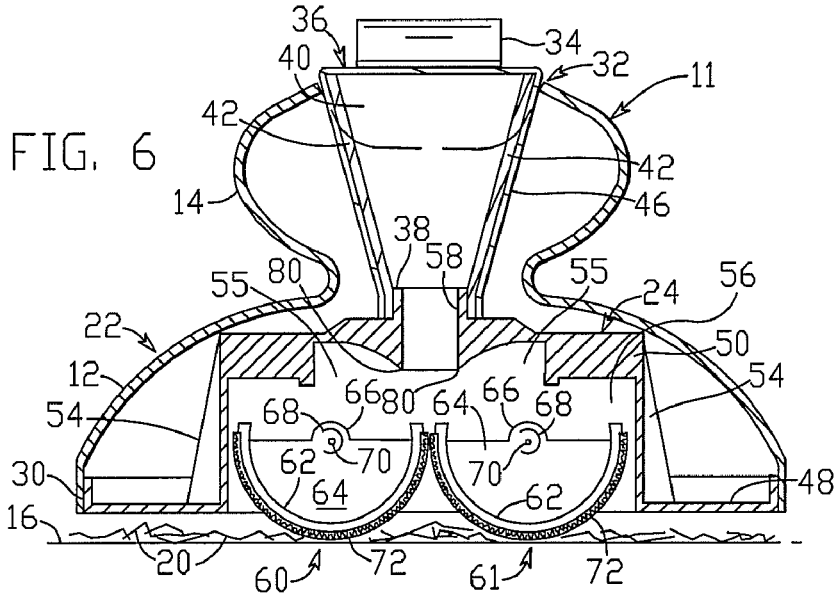
FIG. 6 is a cross-sectional view along line 6-6 of FIG. 1.

Referring now to FIGS. 4-6, the inner housing 24 includes a lower portion 48 and an upper portion 50. The lower portion 48 extends outwardly to conform to the shape of the lower opening 28 in the outer housing 22, and is fixedly secured to the outer housing 22 by suitable fasteners 52. The upper portion 50 is spaced above the lower portion 48 by a pair of opposed supports 54 and end walls 55, preferably integrally formed between the lower portion 48 and the upper portion 50, in order to define a recess 56 between the side supports 54 and end walls 55. The upper portion 50 also includes a central opening 58 having lower edges 80 that extends completely through the upper portion 50 and allows communication between the recess 56 and the narrow open end 38 of the bin 32. To keep the device 10 relatively lightweight, the inner housing 24 is formed of a suitable lightweight material, such as a plastic material.

The recess 56 also houses a pair of cleaning members 60 and 61. The members 60, 61 are generally semi-cylindrical in shape, such that each member 60, 61 includes a curved surface 62, and a pair of arcuate end walls 64. Each end wall 64 includes a protrusion 66 extending outwardly therefrom in which is defined a bore 68 that receives a fastener 70 in order to rotatably secure each end wall 64 to the adjacent end wall 55 of the recess 56. While the preferred embodiment discloses cleaning members 60, 61 that are generally semi-cylindrical in shape, other suitable shapes for the members 60, 61 are also contemplated. Further, the materials utilized to form the cleaning members 60, 61 are selected to maintain the overall light weight for the device 10, such that preferred materials for the cleaning members 60, 61 can include various lightweight metals and plastics.

Each cleaning member 60, 61 also includes a layer of cleaning material 72 secured to the member 60, 61 on the curved surface 62 opposite the end wall 64. The material 72 can be selected from any suitable material capable of picking up and retaining various dirt, dust, pet hair, crumbs, lint and other allergens from a fabric surface 16 such as a number of teeth disposed, and possibly integrally formed on each member or a material secured to the members 60, 61. Preferably, the material is formed of a cloth-like material, with a particularly preferred material being an unidirectional, fabric, such as velour. The layer of cleaning material 72 is secured to the curved surface 62 of the cleaning members 60, 61 in any suitable manner, but is preferably fixedly secured to the curved surface 62 by an adhesive.

The cleaning members 60, 61 are secured within the recess 56 such that the layer of cleaning material 72 on each member 60, 61 extends below the lower portion 48 of the inner housing 24 and into contact with a fabric surface 16 over which the device 10 is moved. Each member 60, 61 is rotatable within the recess 56 between a first position where an inner side 74 (e.g., FIG. 8) is rotated into contact with an annular shoulder 76 (e.g., FIG. 8) formed on the upper portion 50 of the inner housing 24 adjacent the opening 58, and a second position where an outer side 78 (e.g., FIG. 8) of each member 60, 61 is rotated into contact with the upper portion 50 adjacent the corresponding side support 54. Additionally, the thickness of the layer of cleaning material 72 on each member 60, 61 is selected to enable the material 72 on each member 60, 61 to contact the material 72 on the opposed cleaning members 60, 61 for a purpose to be described.

Figure 7:
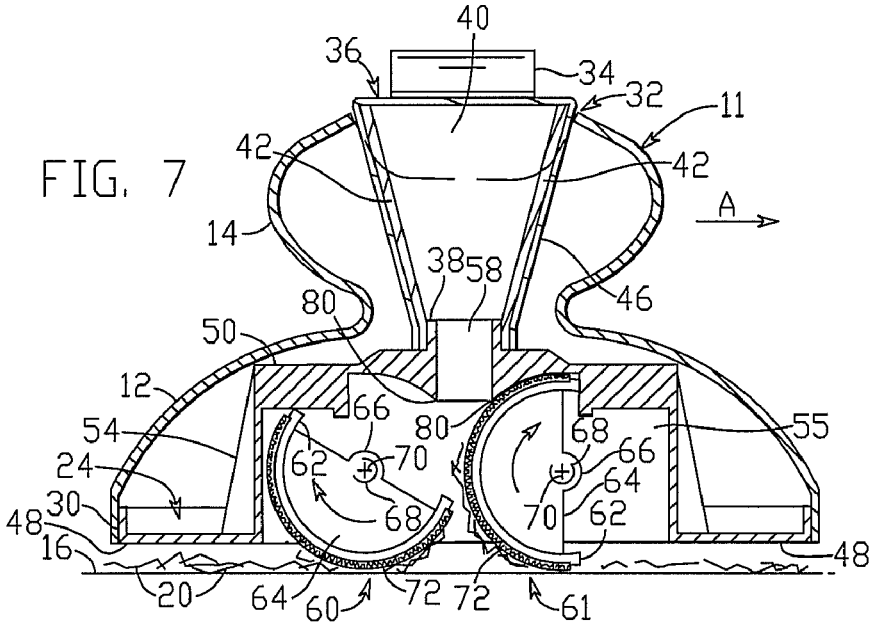
FIG. 7 is a cross-sectional view similar to FIG. 6 illustrating the movement of the cleaning members of the device of FIG. 1 when the device is moved in a first direction.
Figure 8:
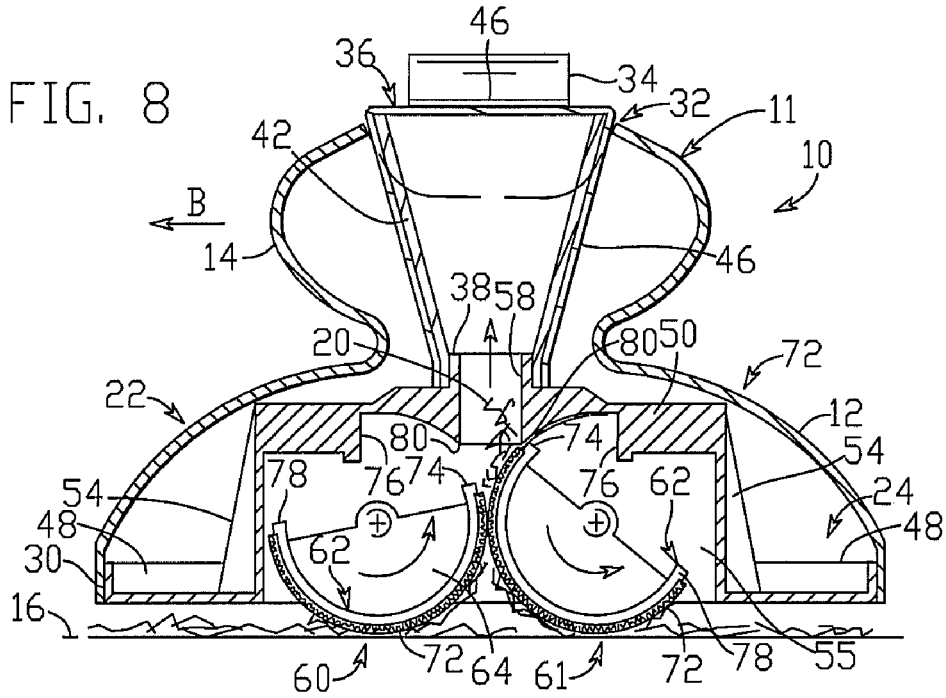
FIG. 8 is a cross-sectional view similar to FIG. 6 illustrating the movement of the rotatable members of the cleaning device when the device is moved in a second direction opposite to FIG. 7.
Figure 9:
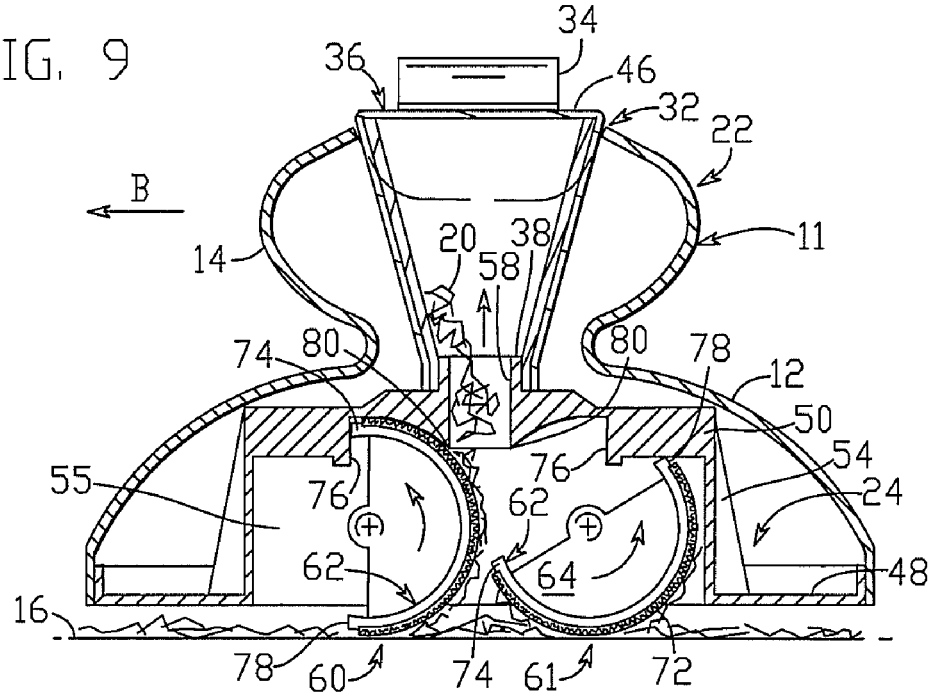
FIG. 9 is a cross-sectional view similar to FIG. 6 illustrating the movement of the rotatable cleaning members when the device is moved further in the direction of FIG. 8.

In operation, referring now to FIGS. 7-9, the device 10 is placed against and moved across a fabric surface 16, and the cleaning members 60, 61 each rotate in a clockwise direction when the device 10 is moved in a direction indicated by arrow A in FIG. 7. As the members 60, 61 rotate in the clockwise direction, the layer of cleaning material 72 on each member 60, 61 contacts the debris 20 on the fabric surface 16 and picks up the debris 20 such that the debris 20 remains on the cleaning material layer 72. The device 10 is continually moved in the direction indicated by arrow A until the cleaning members 60, 61 are moved into the position shown in FIG. 7.

At this point, the device 10 is moved in the opposite direction indicated by arrow B in FIG. 8, such that members 60, 61 rotate in a counterclockwise direction. In doing so, the cleaning material layer 72 on the inner side 74 of member 60 contacts the cleaning material layer 72 adjacent the inner side 74 of cleaning member 61. As the respective layers 72 move past and contact one another, the debris 20 on the member 61 is removed and pushed through the central opening 58 in the upper portion 50 into the open end 38 of the bin 32. The debris 20 engaged between the members 60, 61 is continually urged upwardly into the opening 58, and cannot fall back on the surface 16 due to the close spacing of the members 60, 61. At the same time, the cleaning material layer 72 spaced from the inner side 74 of member 61 comes into contact with the fabric surface 16 in order to pick up additional debris 20 from the surface 16. Movement in the direction indicated by arrow B is continued in this manner until, as best shown in FIG. 9, the position of the cleaning members 60, 61 are essentially reversed from FIG. 7. From the position shown in FIG. 9, the device 10 is again moved in a direction indicated by arrow A in FIG. 7 such that the inner side 74 of cleaning member 61 comes into contact with and cleans the debris 20 off of the cleaning material 72 of cleaning member 60, which picks up debris 20 from the surface 16 as it is moved. This process can be repeated as many times as necessary in order for the cleaning members 60, 61 to remove all of the debris 20 off of the fabric surface 16.

The removal of the debris 20 from the cleaning material layer 72 on each cleaning member 60, 61 is further facilitated by the presence of the debris diverting edge 80 formed on the upper portion 50 of the inner housing 24 on each side of the central opening 58. The edges 80 on each side of the opening 58 contact the cleaning material layer 72 on the respective cleaning members 60, 61 when the members 60, 61 move into the positions shown in FIGS. 7 and 9 to assist in diverting and removing the debris 20 from the cleaning material 72. The edges 80 contact the layers 72 on the members 60, 61 to compress the layers 72 and scrape or otherwise direct the debris 20 from the layers 72 into the opening 58. Continued motion of the members 60, 61 moves the layers 72 along the edges 80 to remove additional debris 20 from the members 60, 61.

After the debris 20 has been removed from the fabric surface 16, an individual can remove and replace the bin 32, if necessary, or can utilize the device in order to remove debris 20 from an additional fabric surface or surfaces 16. In addition, as opposed to the bin 32 being designed for removal and disposal separately from the device 10, the entire device 10 can be designed to be disposed once the bin 32 has been filled with debris 20 removed from one or more fabric surfaces 16.

Additionally, separate from the previously described embodiments, other modifications to the device 10 are also contemplated as within the scope of the invention. For example, the chamber or bin 32 can be integrally formed with the outer housing 22, such that the entire device is disposable. Also, the chamber 32 can include or be formed of a hair or lint attracting material, such as a strip of a tacky material or a hook and loop material to trap any lint, hair or other debris contacting it. Also, the opening 58 in the inner housing 24 could be moved to one side or the other of the inner housing 24, along with a corresponding shift in the location of the chamber 32.

Figure 10:
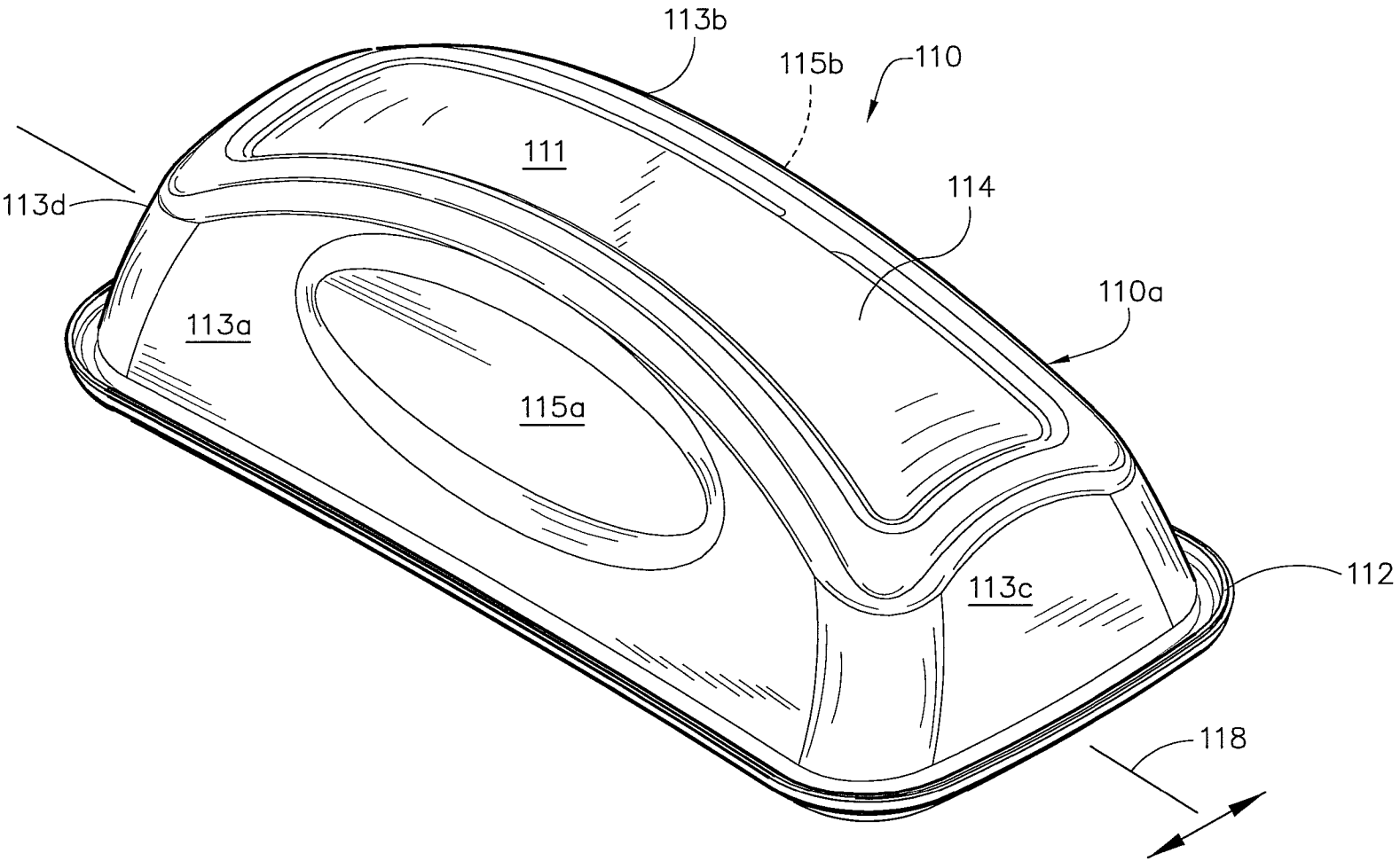
FIG. 10 is perspective view of another embodiment of fabric sweeper device viewed from in front of, above, and from the left side of the fabric sweeper.
Figure 11:
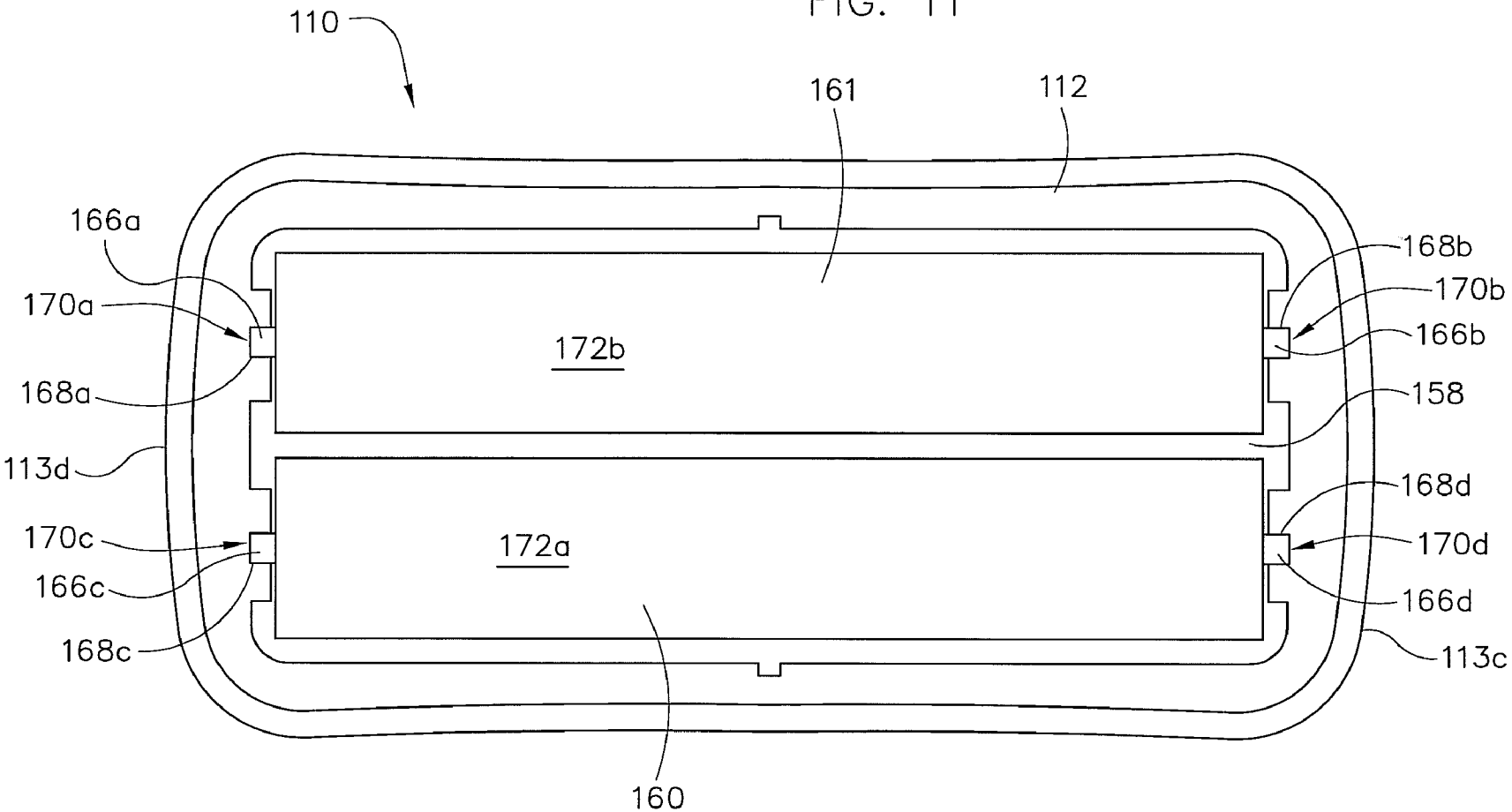
FIG. 11 is a bottom plan view of the device of FIG. 10.
Figure 12:
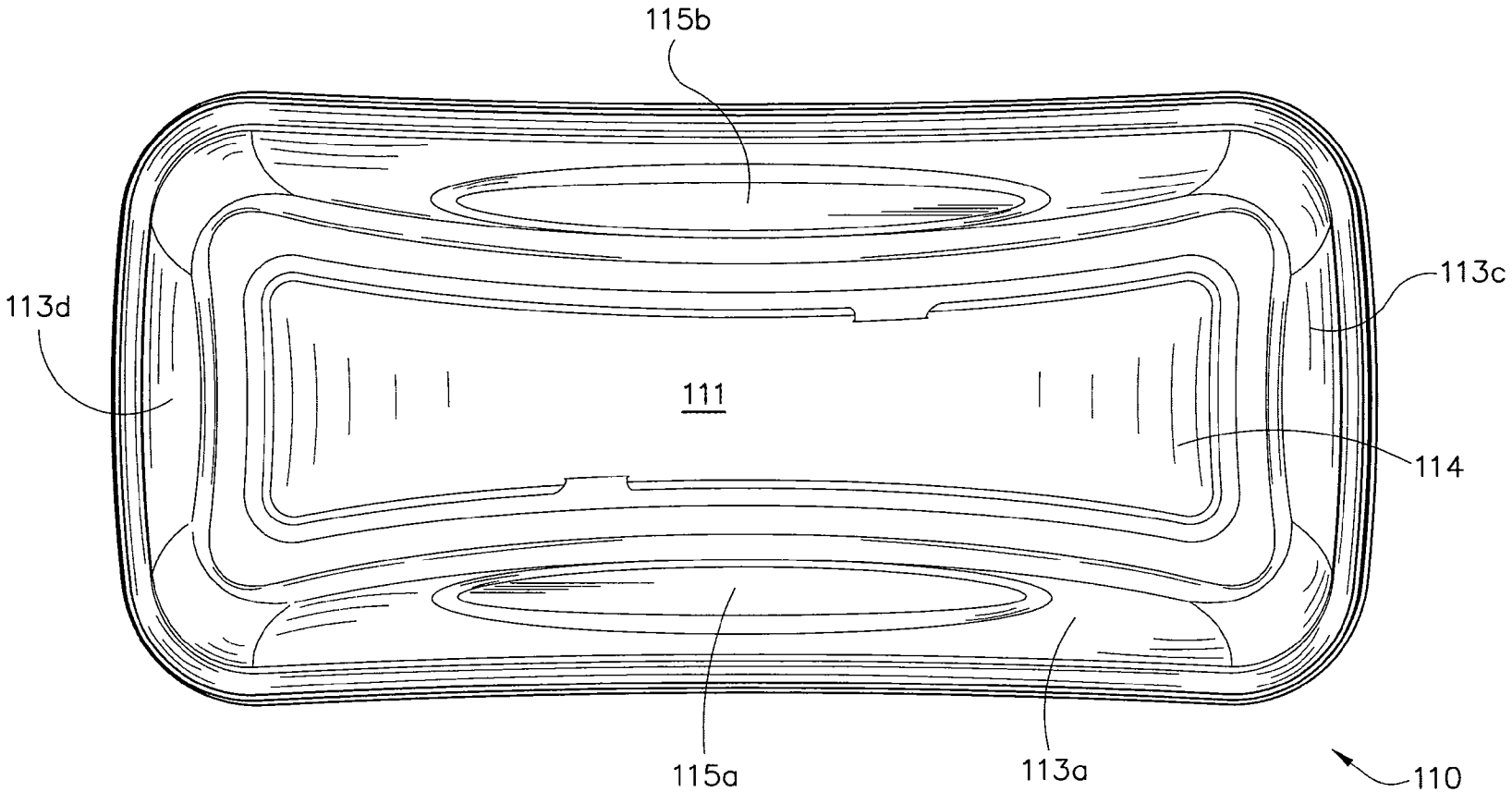
FIG. 12 is a top plan view of the device of FIG. 10.
Figure 13:
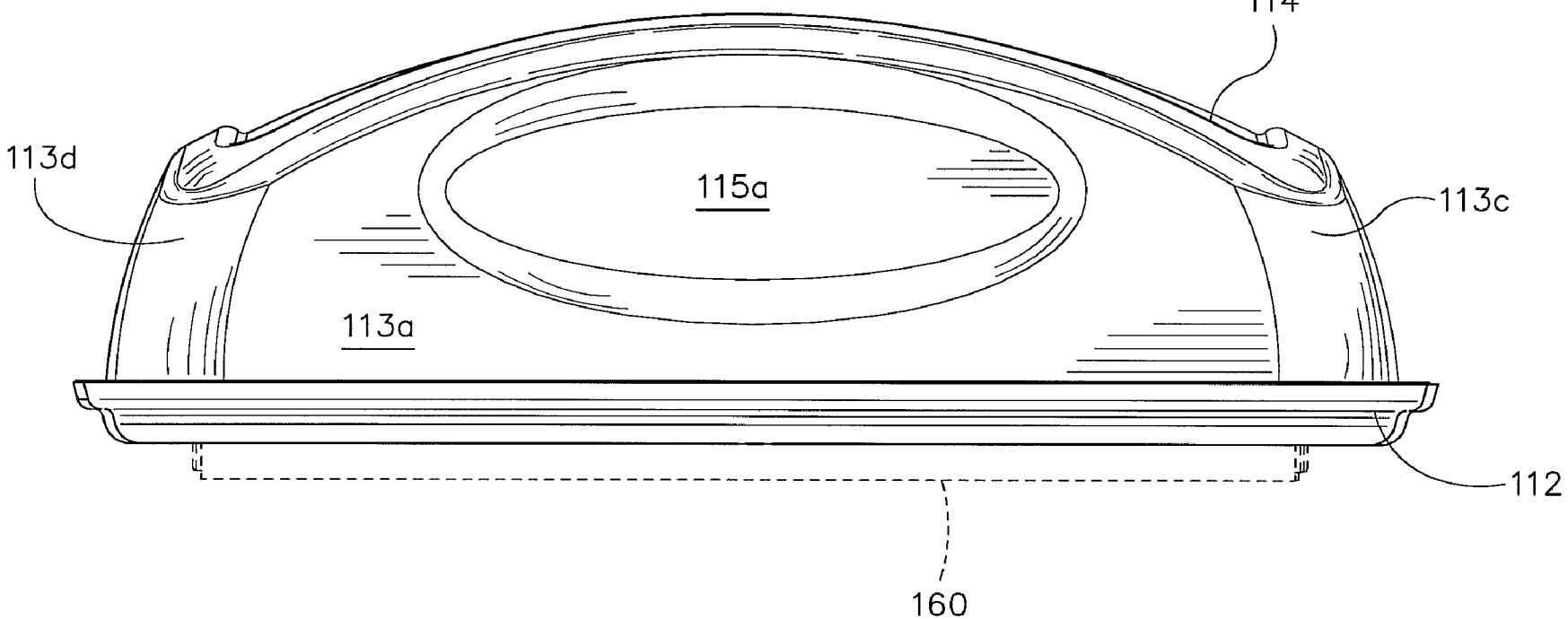
FIG. 13 is a side elevation view of the device of FIG. 10, with the other side being a mirror image of the first side showing the rollers in phantom.
Figure 14:
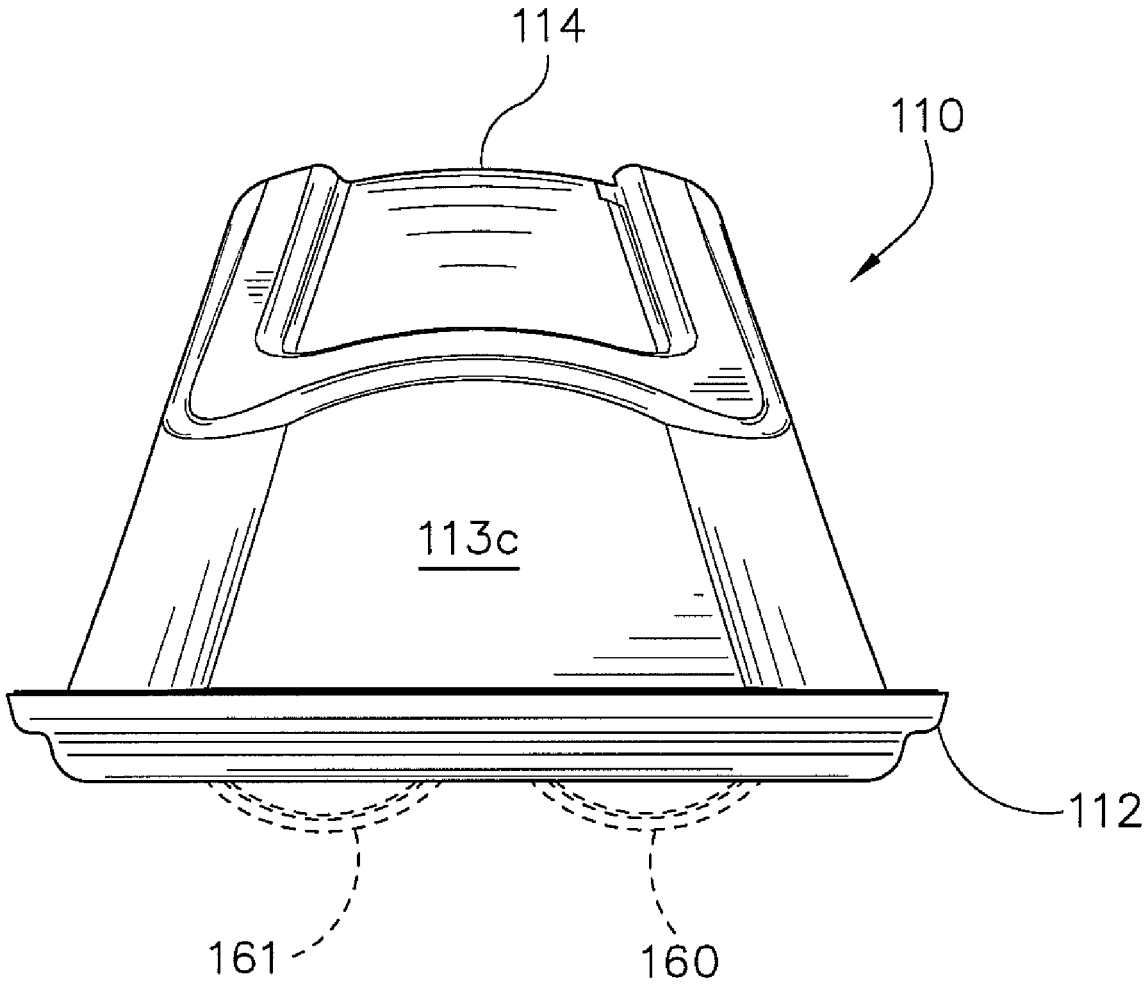
FIG. 14 is a front elevation view of the device of FIG. 10, with the rear being a mirror image thereof and showing the rollers in phantom.
Figure 15:
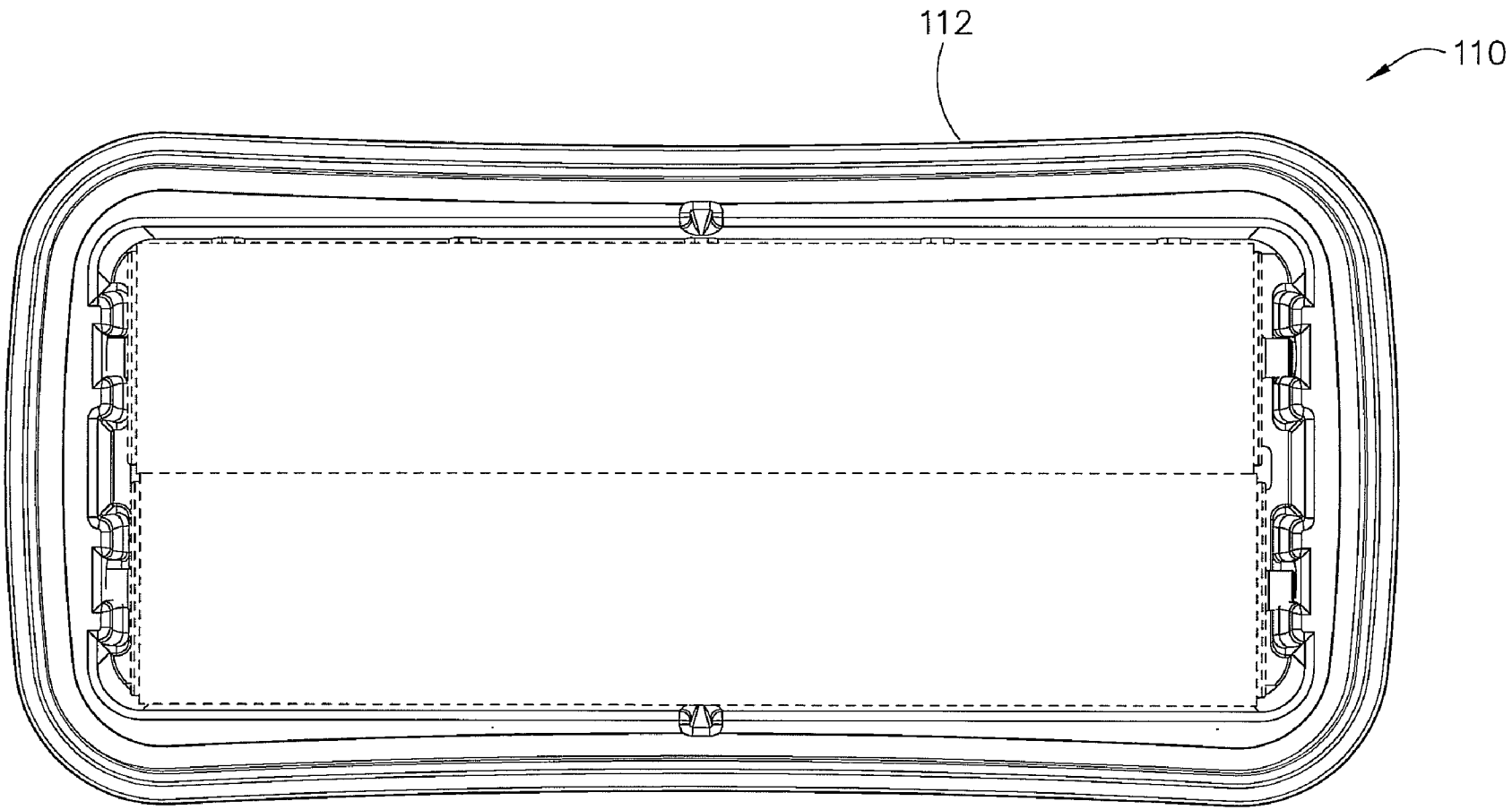
FIG. 15 is a bottom plan view of the device of FIG. 10 with the rollers in place in phantom.

FIG. 10 shows an alternative device 110. The device 110 has a housing 110*a* with base portion 112 and a handle portion 114 preferably connected by an adhesive or heat staking. The device cleans the surface along axis 118. The handle portion 114 preferably has a top 111, a first side 113*a*, an opposing second side 113*b*, a front side 113*c*, and back side 113*d*. The first side and the second side have grooves 115*a*, 113*b* for receiving the user's hand and fingers. The grooves allow the user to comfortably grip a handle portion. FIG. 11 shows the underside of the device 110. As seen in FIG. 11 the base portion 112 is configured to receive cleaning members 160, 161. The cleaning members are preferably covered with cleaning material 172*a*, 172*b* such as an unidirectional velour. The cleaning members 160, 161 are preferably semicircular rollers such as those described above. In this embodiment, the rollers 160, 161 are attached to the base portion 112 with fasteners 170*a*, 170*b* and 170*c*, 170*d* located at each end of the roller. In between the rollers is a central opening 158. In this embodiment, fasteners 170*a*, 170*b* are preferably constructed of two main elements—for example, protrusions 166*a* and 166*b* that are respectively received in the cavities 168*a* and 168*b* for roller 161. Similarly, roller 160 has fasteners 170*c*, 170*d* that include protrusions 166*c* and 166*d* that are respectively received in the cavities 168*c* and 168*d*.

As shown in FIGS. 12-15, handle portion 114 has a top 121 that is preferably smooth and rounded. The sides 113*a*, 113*b*, 113*c*, 113*d* preferably have rounded corners as shown.

Figure 16:
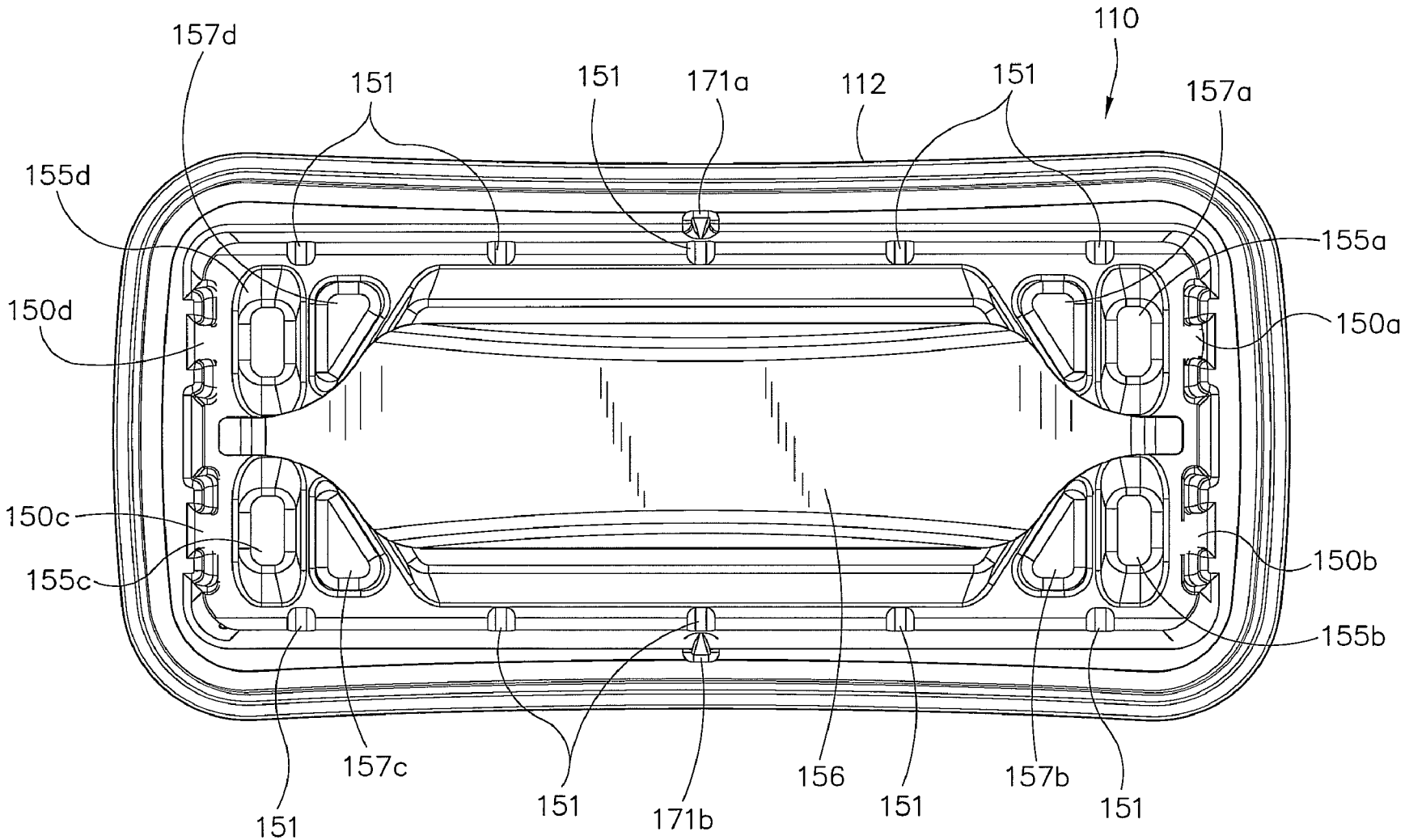
FIG. 16 is another bottom plan view of the device of FIG. 10 with the rollers removed.
Figure 17:
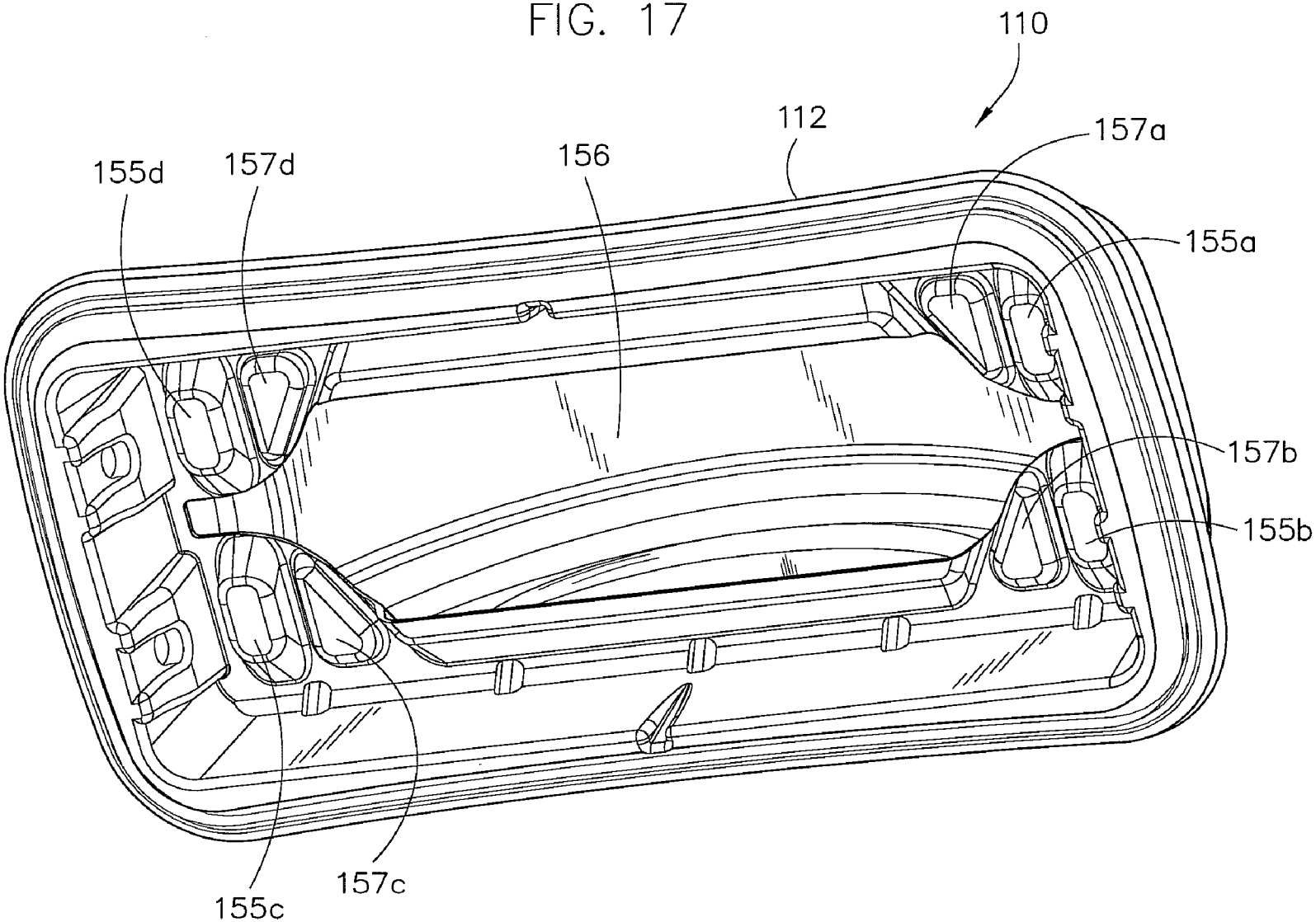
FIG. 17 is a perspective view, viewed from below the fabric sweeper or FIG. 10 with the rollers removed.
Figure 18:
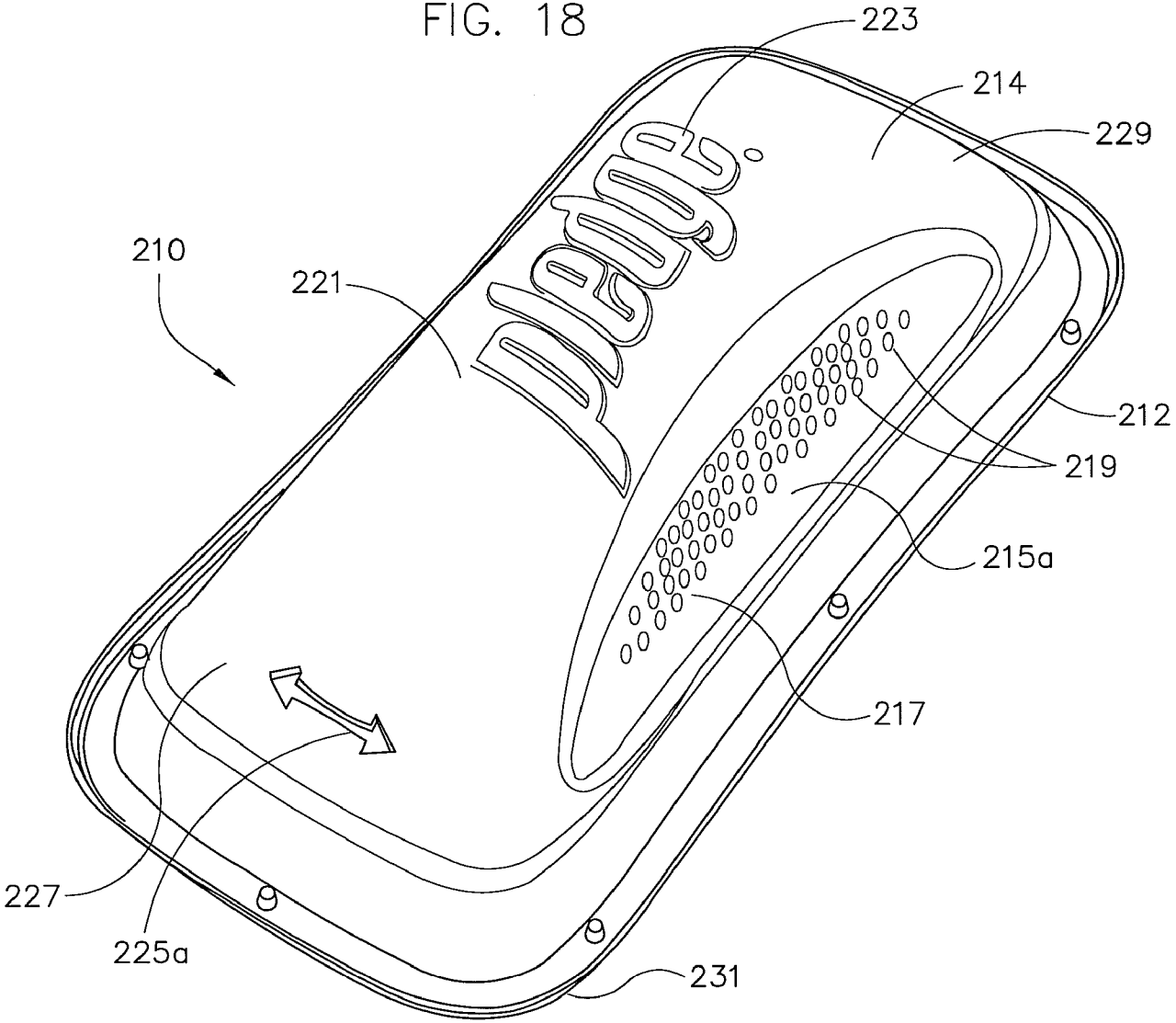
FIG. 18 is a perspective view of yet another embodiment of the fabric sweeper design, viewed from in front of, above, and from the right side of the fabric sweeper.

FIGS. 16 and 17 show the base portion 112 of the device 110 with the rollers removed. When the rollers are on place, they fit into fastening clip cavities 150*a*-150*d*. Handle portion 114 and base portion 112 are connected and/or aligned at points 151 as shown. In one embodiment, ribs may be present (on either portion) to help align the handle and base portions 114, 112 respectively and also keep the handle portion 114 stable and firm. Stops 155*a*-155*d* help to restrict the movement of the rollers. Protrusions 157*a*-157*d* are preferably next to the stops 155*a*-155*d*. A rib may be between these to add stability. As handle portion 114 and base portion 112 are essentially hollow, they define a recess 156 into which debris that is picked up by the rollers is stored. In one embodiment, the handle 114 and base portion 112 are transparent so that the user can easily determine when the recess 156 is full of debris. In this embodiment, since the top and bottom portions are permanently connected at, for example, points 151 and/or points 171*a,b* and the rollers are locked into place, the device is then discarded along with the debris. A new device then must be purchased and used for further cleaning.

Another embodiment is shown in FIGS. 18-24. The device 210 is somewhat similar to device 110 but it contains additional features. The device 210 has a handle portion 214 and a bottom portion 212 connected preferably by heat formed connector stakes 271*a-f* that fit into corresponding holes in the handle portion 214. On the top 221 of the handle portion 214 are indicia 223. The indicia 223 preferably indicate the device's type or brand and may also consist of a logo as well as the trademark registration symbol 223*a*. Additional indicia 225*a,b* may be located at the front 227 and back 229 of the device 210. The indicia may include an arrow or arrows that indicates to the user that preferred direction of movement for the device.

In this embodiment, the grooves 215*a,b*, preferably having textured surface 217 consisting of small protrusions or indentations, grip points 219 that assist in the gripping of the device 210. The grooves 215*a,b* are ergonomically designed and accommodate a wider variety of hand sizes. The height of the grooves 215*a,b* prevent squeezing of the rollers 260, 261 when the device 210 is used. When properly gripped by a user, the user's hand is properly orientated relative to the usage direction.

Figure 19:
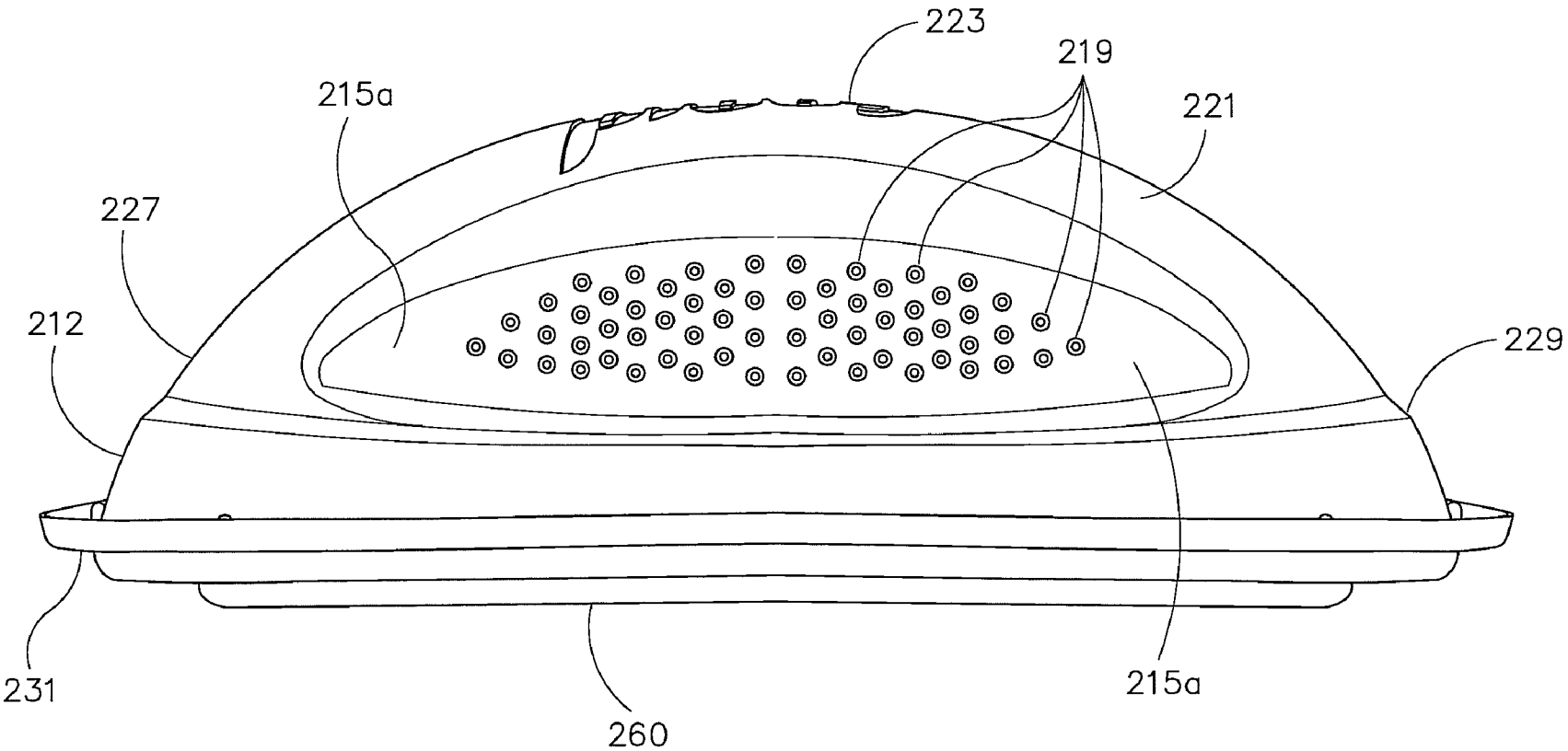
FIG. 19 is a side view of the device of FIG. 18 with the other side being a mirror image of the first side and showing the rollers.
Figure 20:
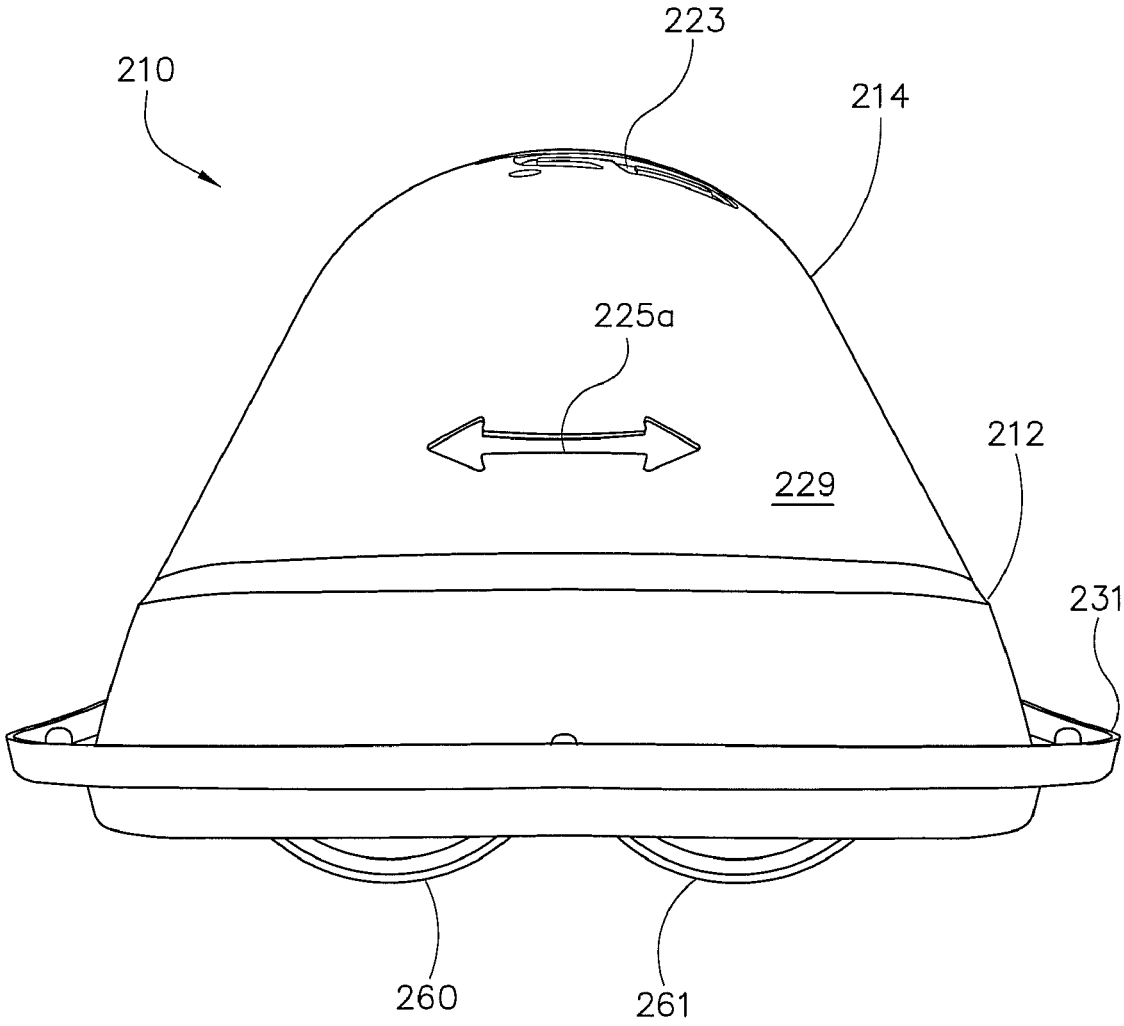
FIG. 20 is a rear elevation view thereof, with the front being a mirror image of the rear and showing the rollers.
Figure 21:
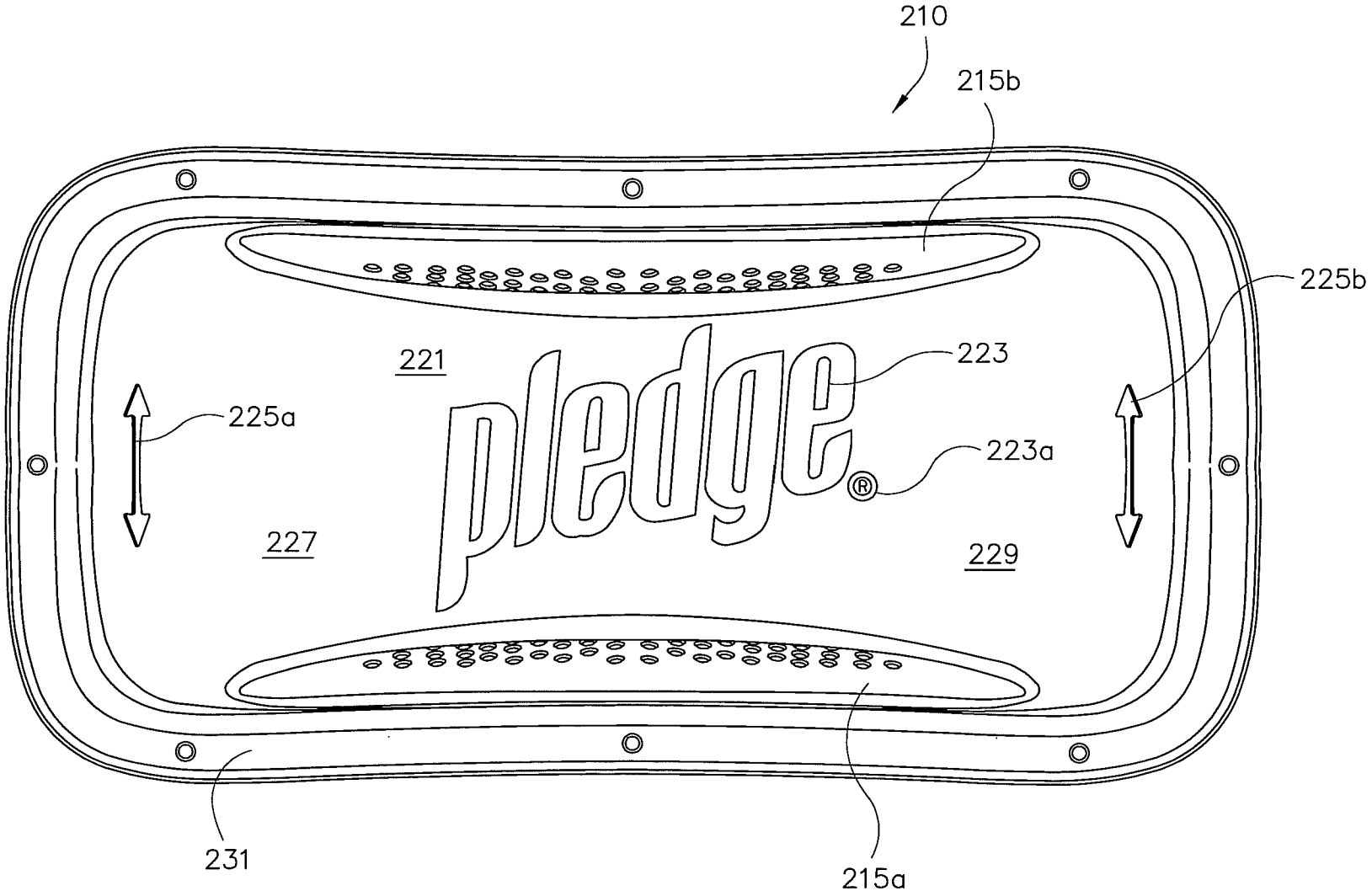
FIG. 21 is a top plan view of the device of FIG. 18.

This embodiment may also include ridge 231 around bottom portion 212. The ridge 231 may have a rounded lip to prevent snags. As best shown in FIGS. 19-21, this embodiment is more rounded and almost appears to be a semi circle. As shown, two rollers 260, 261 are located partially within the outer shell of the device 210. The grip points 219 and indicia 223 may be embossed out or in.

Figure 22:
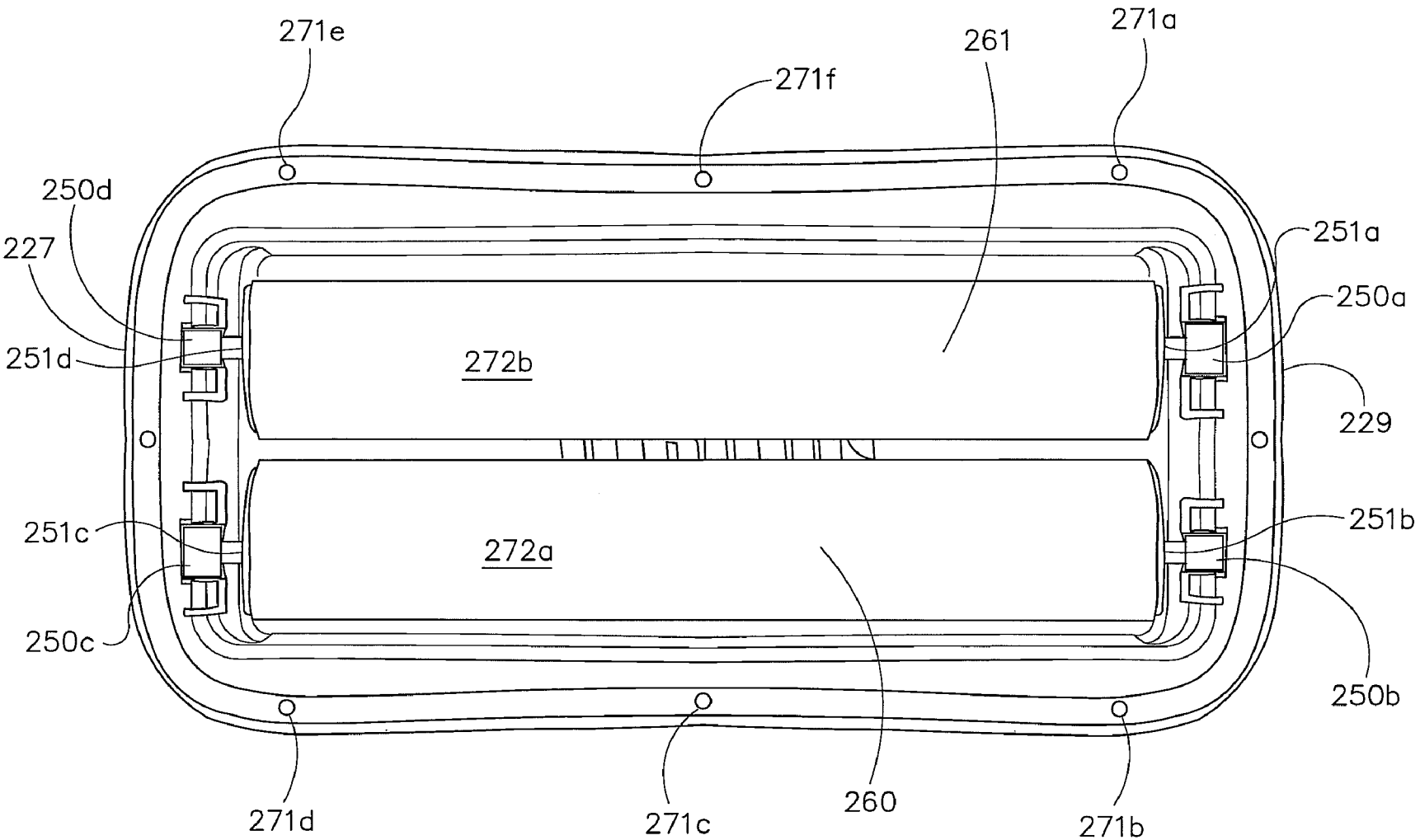
FIG. 22 is a bottom plan view of the device of FIG. 18 showing the rollers.
Figure 23:
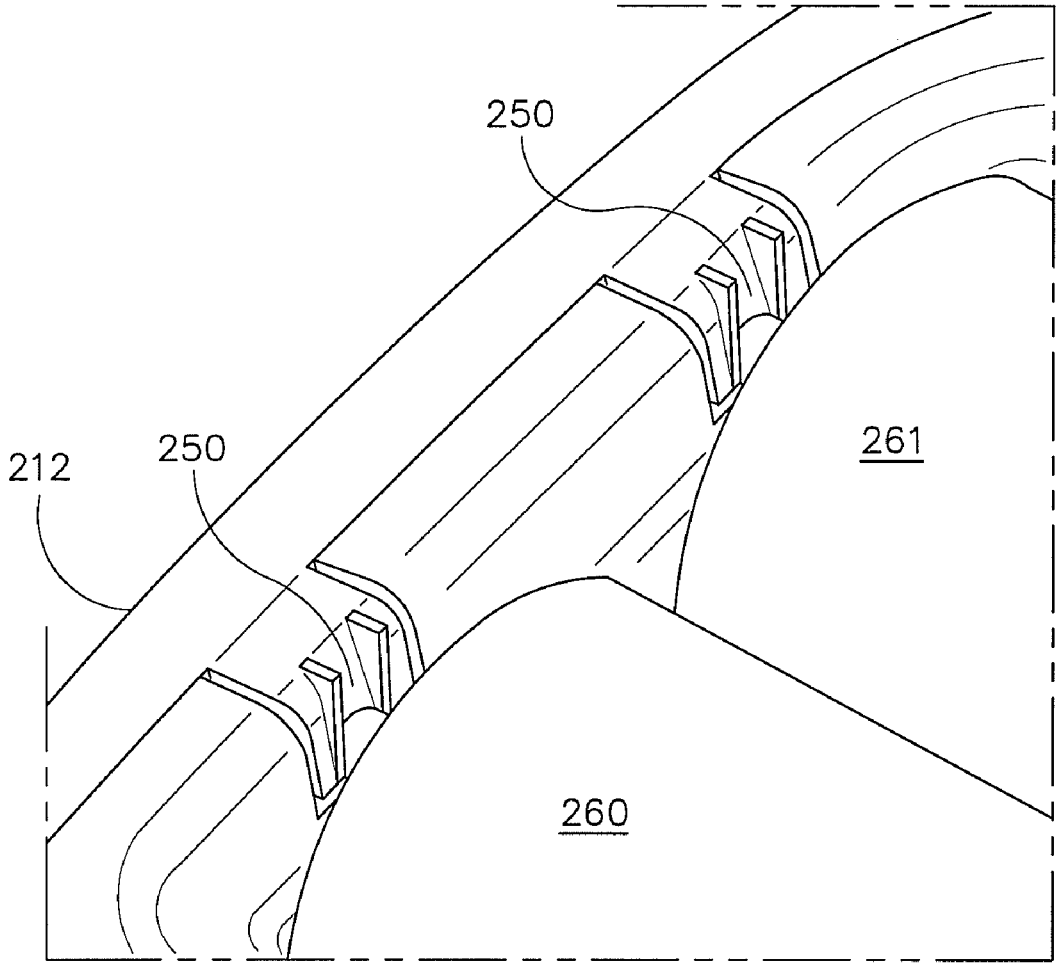
FIG. 23 is a magnified perspective view, viewed from below, from the left side, and toward the rear of the fabric sweeper and the rollers.

FIGS. 22 and 23 show rollers 260, 261 covered with a cleaning fabric 272*a*, 272*b*. FIG. 22 shows a somewhat different fastening mechanism for the rollers 260, 261. Spring snaps receive a protrusion on the rollers 260, 261 for easier assembly. The bottom of the base portion 212 has ramps or leads 250 to help assemble the rollers 260, 261 into the base 212. The rollers 260, 261 may have protruding axles 251*a*-251*d* of differing sizes which interact with the leads 250*a*-250*d*. The rollers 260, 261 are longer than similar known devices which significantly increases the amount of area covered per swipe.

Figure 23A:
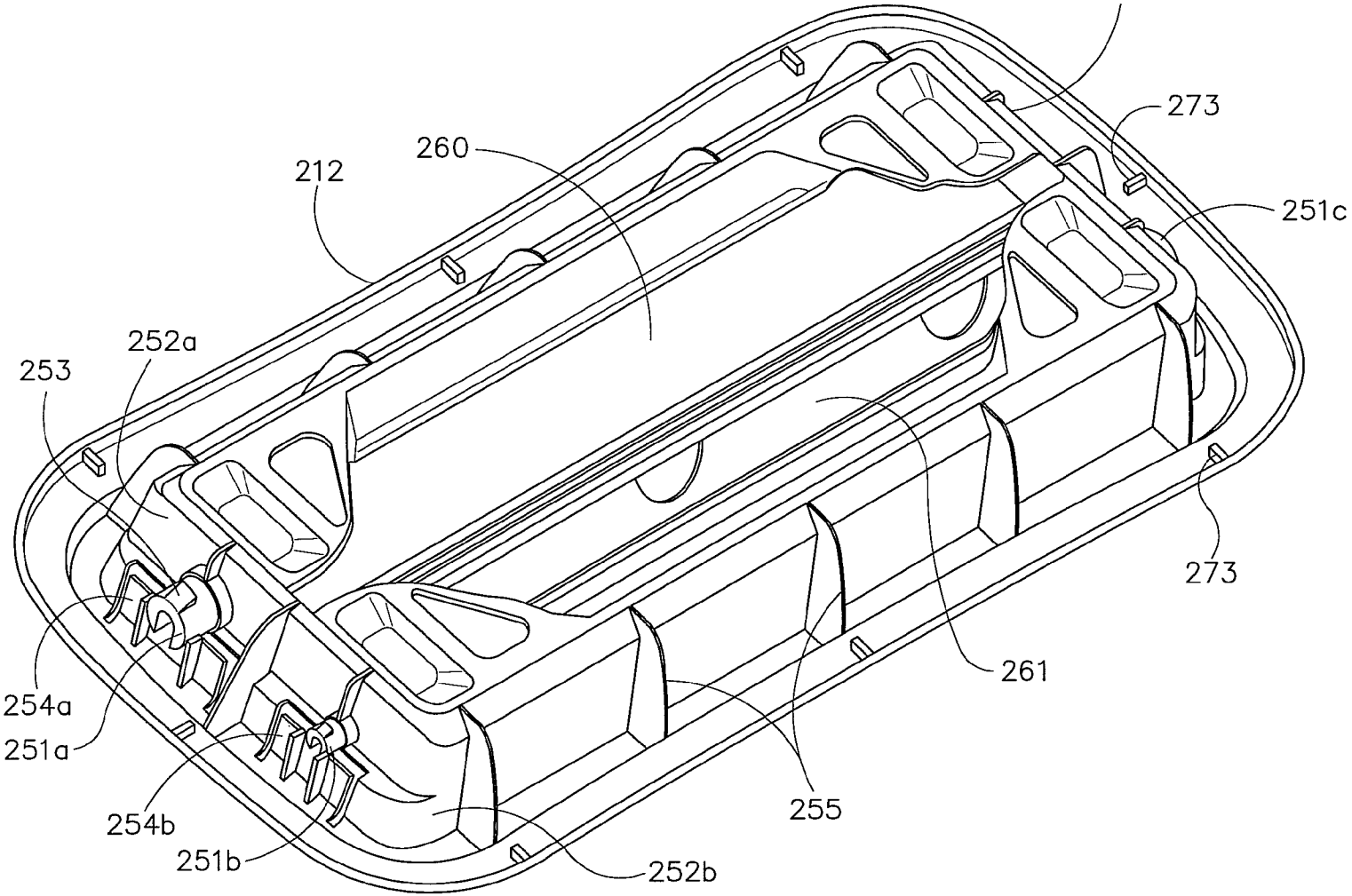
FIG. 23A is a bottom plan view of an alternate embodiment of the device of FIG. 18.

FIG. 23A shows another embodiment of a base portion 212 with rollers 260, 261. Multiple ribs 255 help keep the handle portion 214 and bottom portion 212 properly aligned during the heat staking steps of the assembly process. Slots 273 are used in the heat staking process rather than stakes 271 discussed above. Ribs 255 also add rigidity and strength to the finished device 210 which can help prevent accidental crushing when using the device 210. Different sized axles 251*a-d* are received into corresponding different sized holes 252*a-d* to prevent misassembly during the production process. Living hinges 254*a-d* allow for ease of installing rollers 260, 261 into the bottom portion 212. Locks 253 secure rollers into the base portion 212. The geometry of the base portion 212 funnels air into the handle portion 214 to prevent back pressure.

Figure 23B:
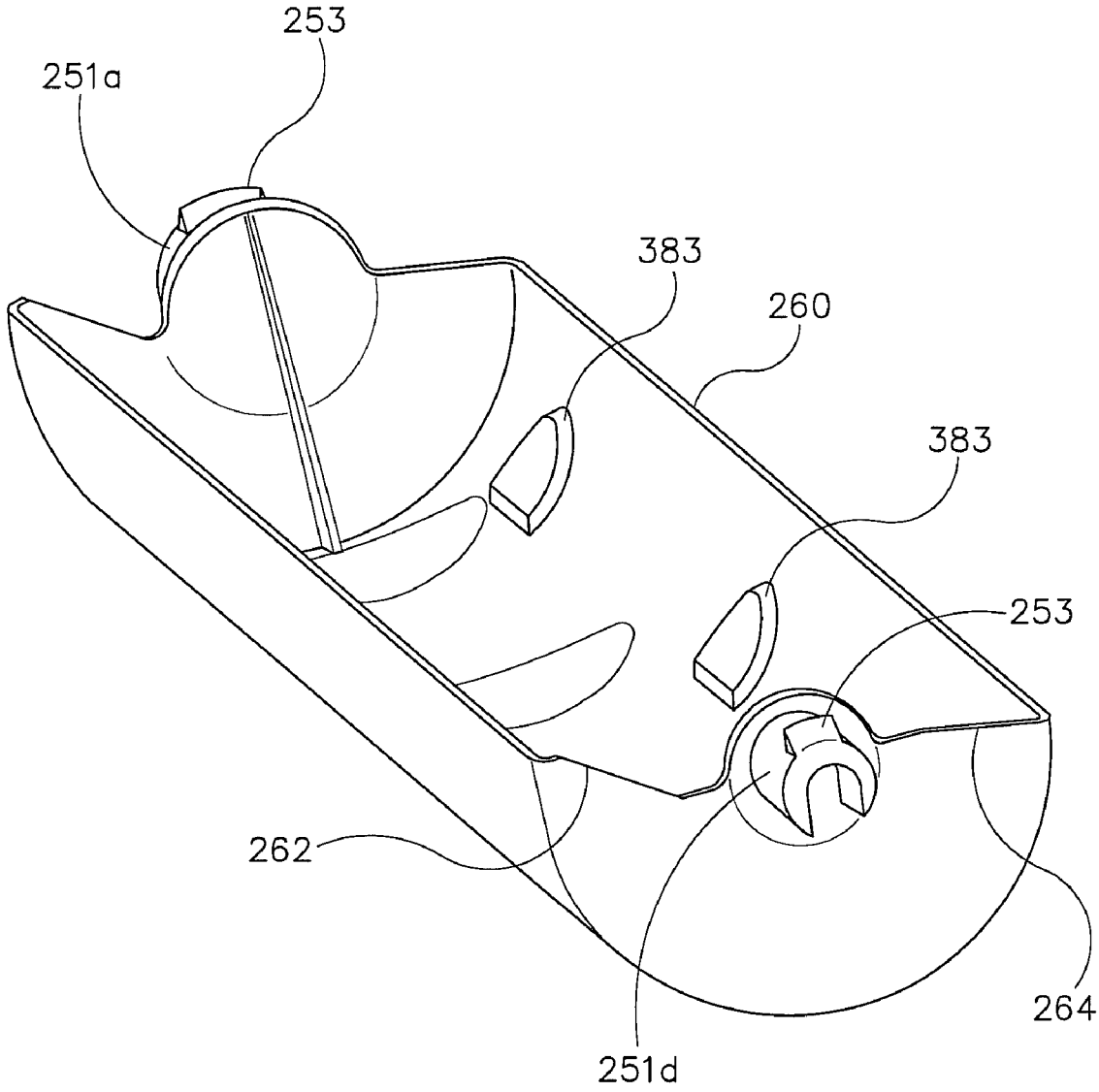
FIG. 23B is a perspective view of one of the rollers from the device of FIG. 23A.

FIG. 23B shows an alternate embodiment of a roller 260 removed from the base portion 212 of FIG. 23A. The roller 260 is hollowed out and its geometry is such to permit contiguous surface contact during operation. The axles 251*a*, 251*d* are of differentiated sizes and may also be hollow. Locks 253 located on each end of the roller axles 251*a*, 251*d* lock the roller 260 in place to prevent its removal, either accidentally or intentionally by consumers. The front of each roller 260, 261 has an extended edge 262 that engages the opposing roller 260, 261 sooner than rollers without raised leading edges. The back of the rollers 260, 261 have a slightly downward-sloped edge 264 which allow the rollers 260, 261 to rotate further backwards than would otherwise be possible with rollers without the slightly downward-sloped edges. The configuration of these front and back edges puts the initial contact with debris to be picked up closer to the clean-off zone on the rollers 260, 261.

Figure 24:
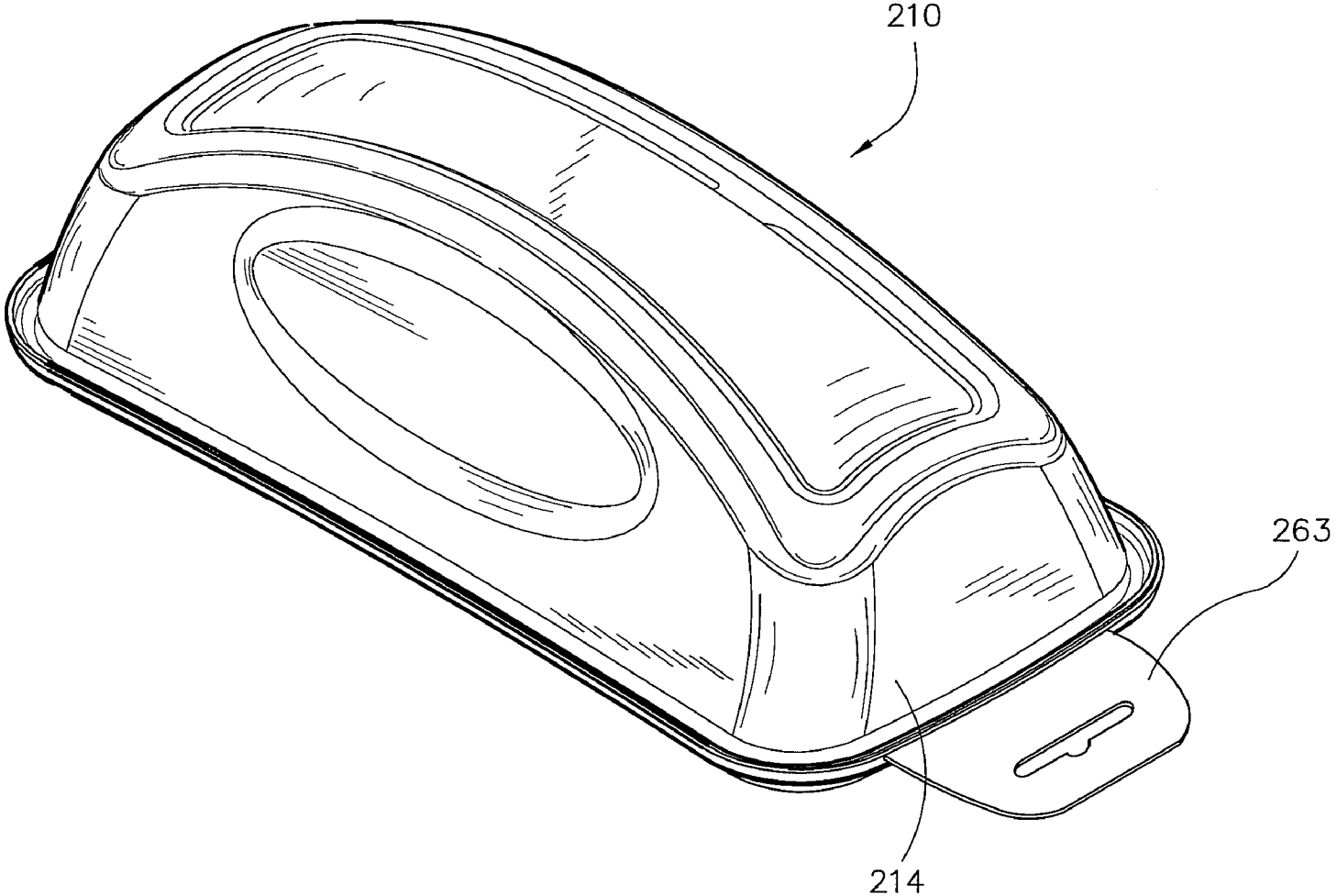
FIG. 24 is a magnified perspective view, viewed from above, from the right side, and toward the front of the fabric sweeper.

FIG. 24 shows a hanger 263 as an integral part of the handle portion 214. In this embodiment, a hanger 263 is preferably constructed of plastic and is used to hang the device 210 from a hook on store display.

Figure 25A:
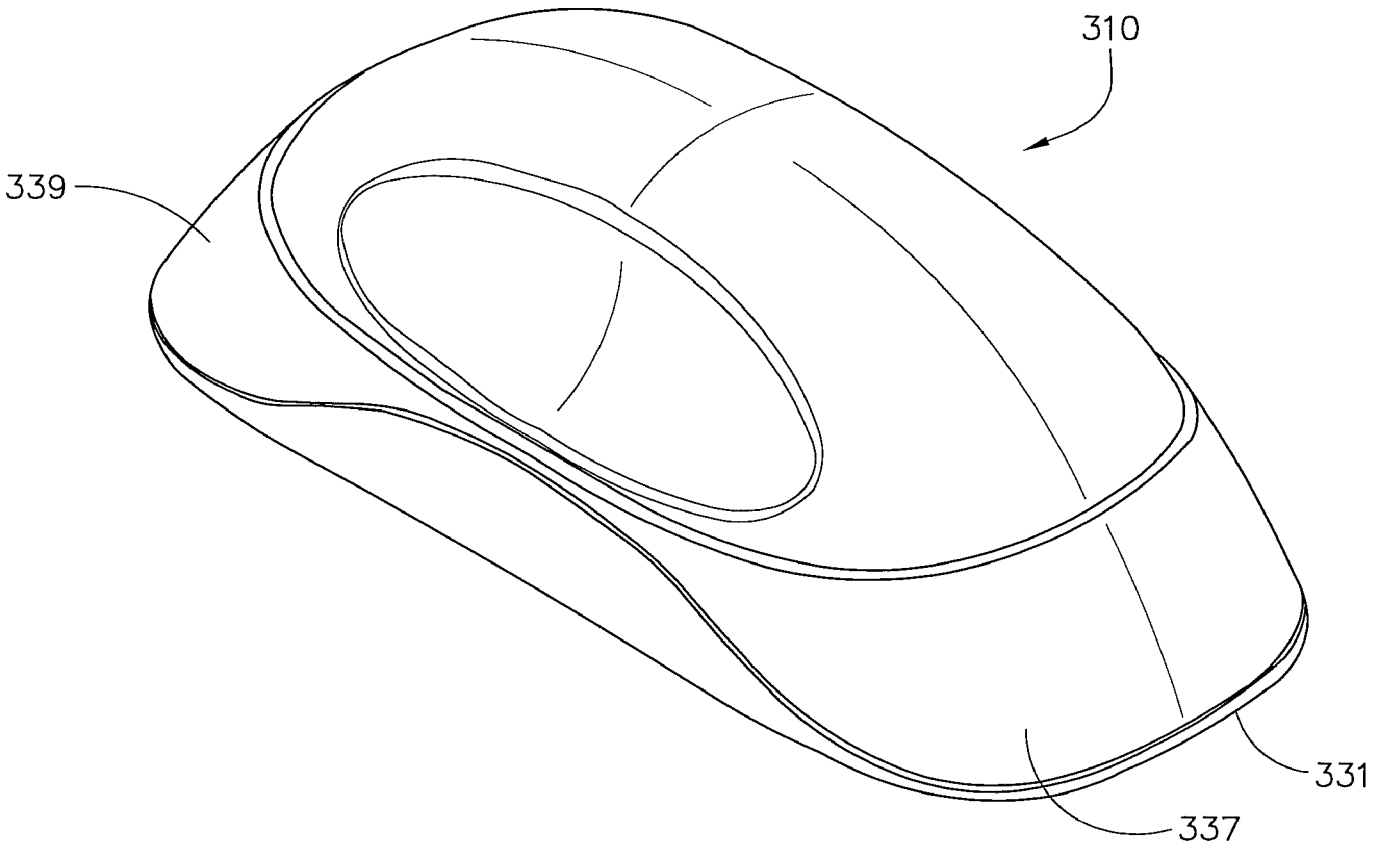
FIG. 25A is a perspective view of still another embodiment of the fabric sweeper, viewed from in front of, above, and from the left side of the fabric sweeper.

FIG. 25A shows still another embodiment. In this embodiment, device 310 has a very small ridge 331 and also has a more aggressively sloping front 337 and rear 339.

Figure 25B:
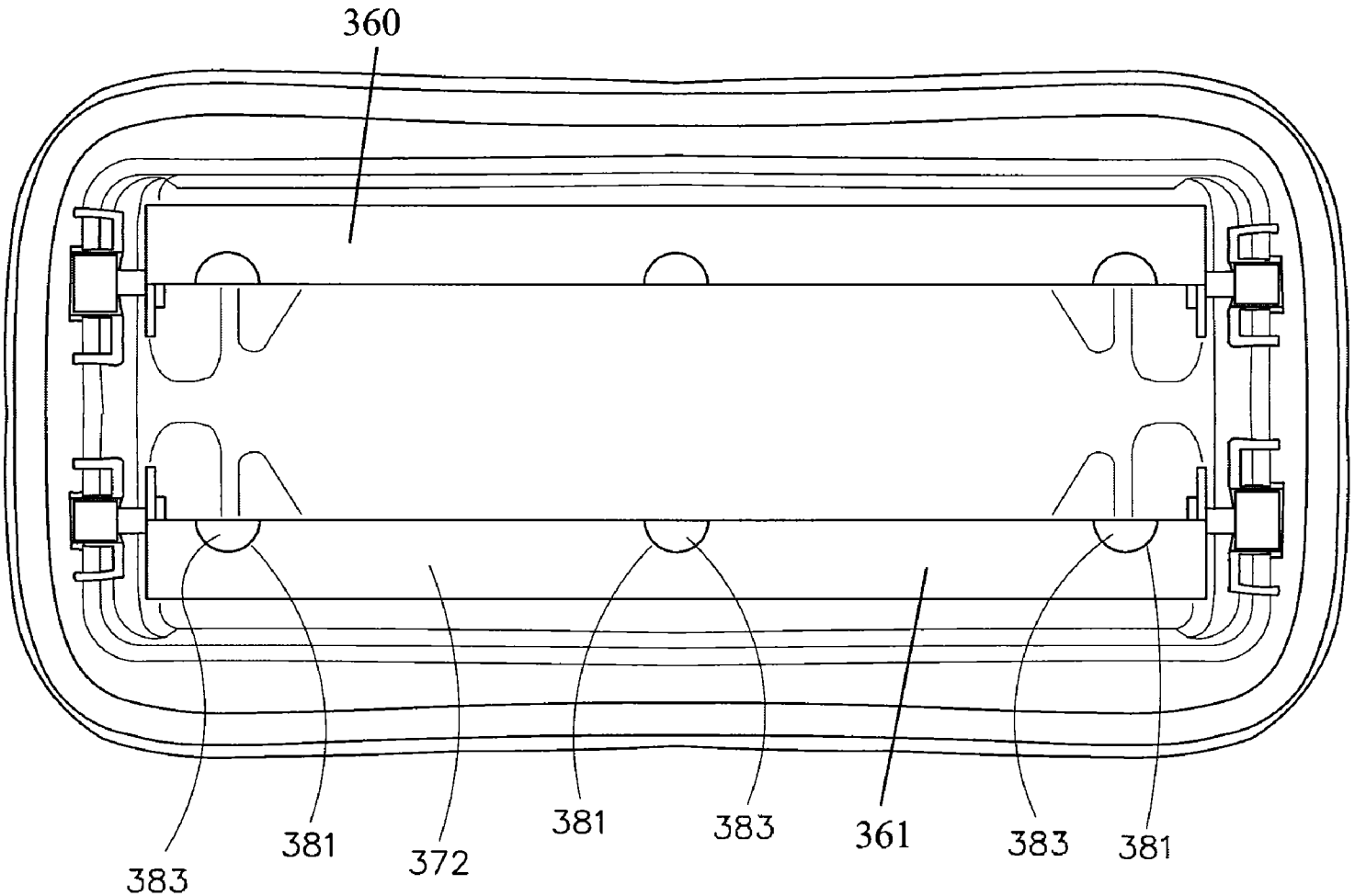
FIG. 25B is a bottom plan view of the device of FIG. 25A.
Figure 26:
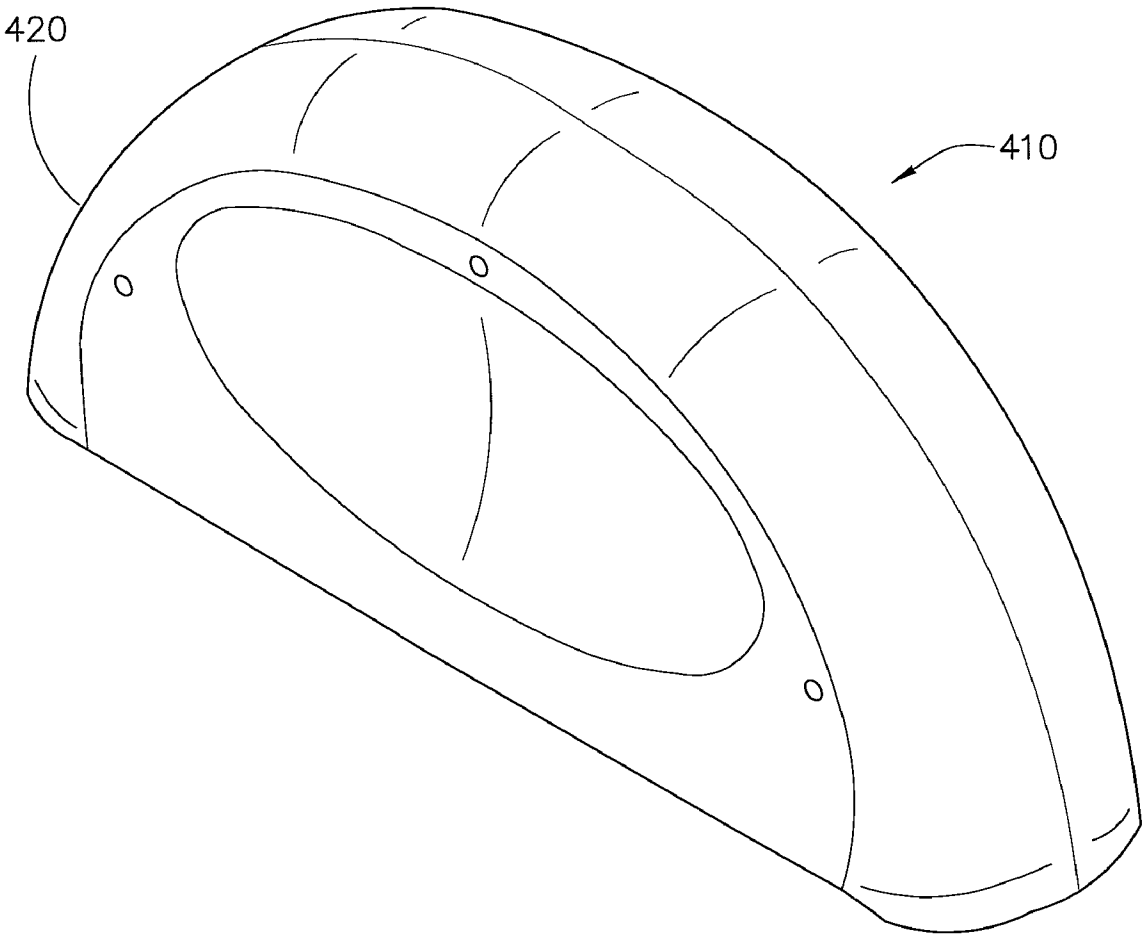
FIG. 26 is a perspective view of yet another embodiment of the fabric sweeper, viewed from in front of, above, and from the left side of the fabric sweeper.
Figure 27:
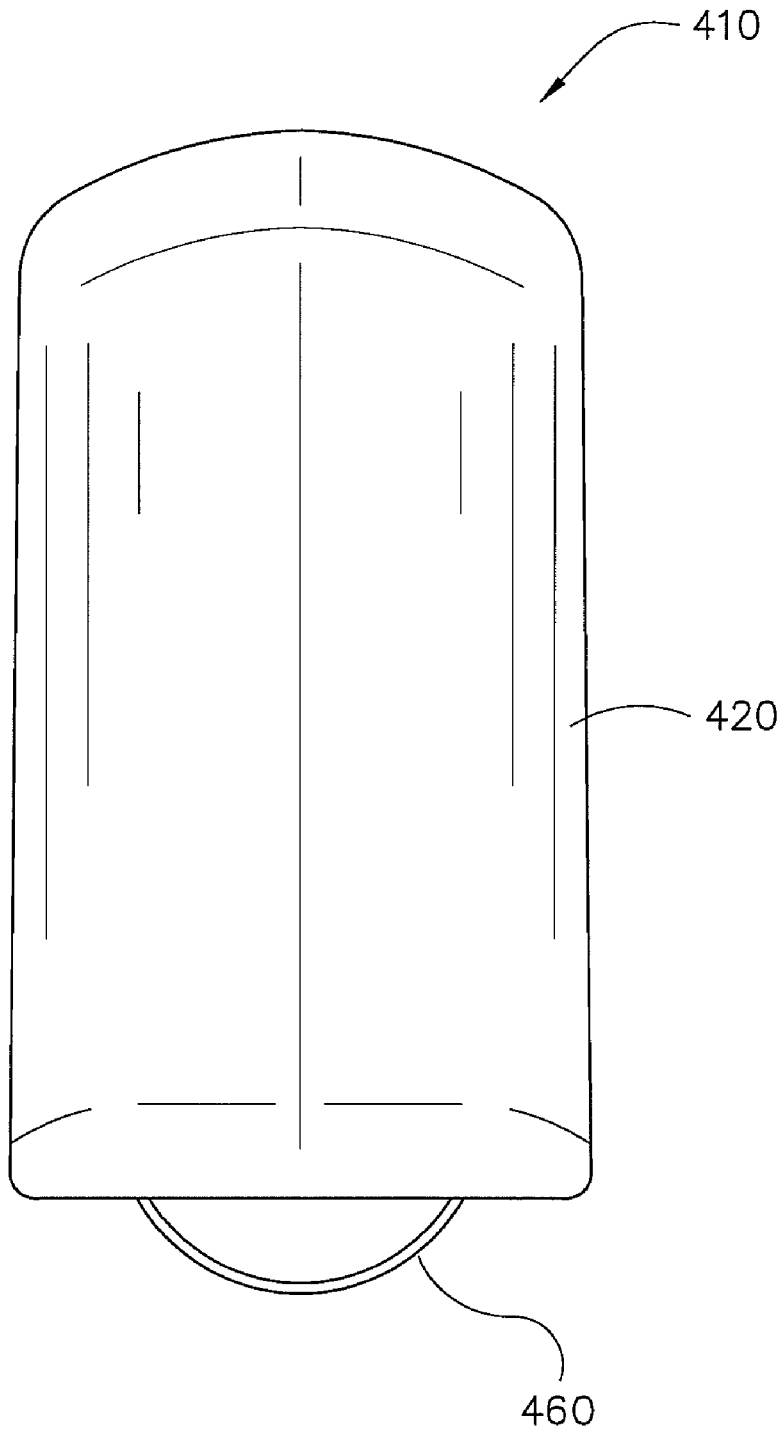
FIG. 27 is a rear elevation view of the device of FIG. 26, with the front being a mirror image of the rear showing the roller in place.
Figure 28:
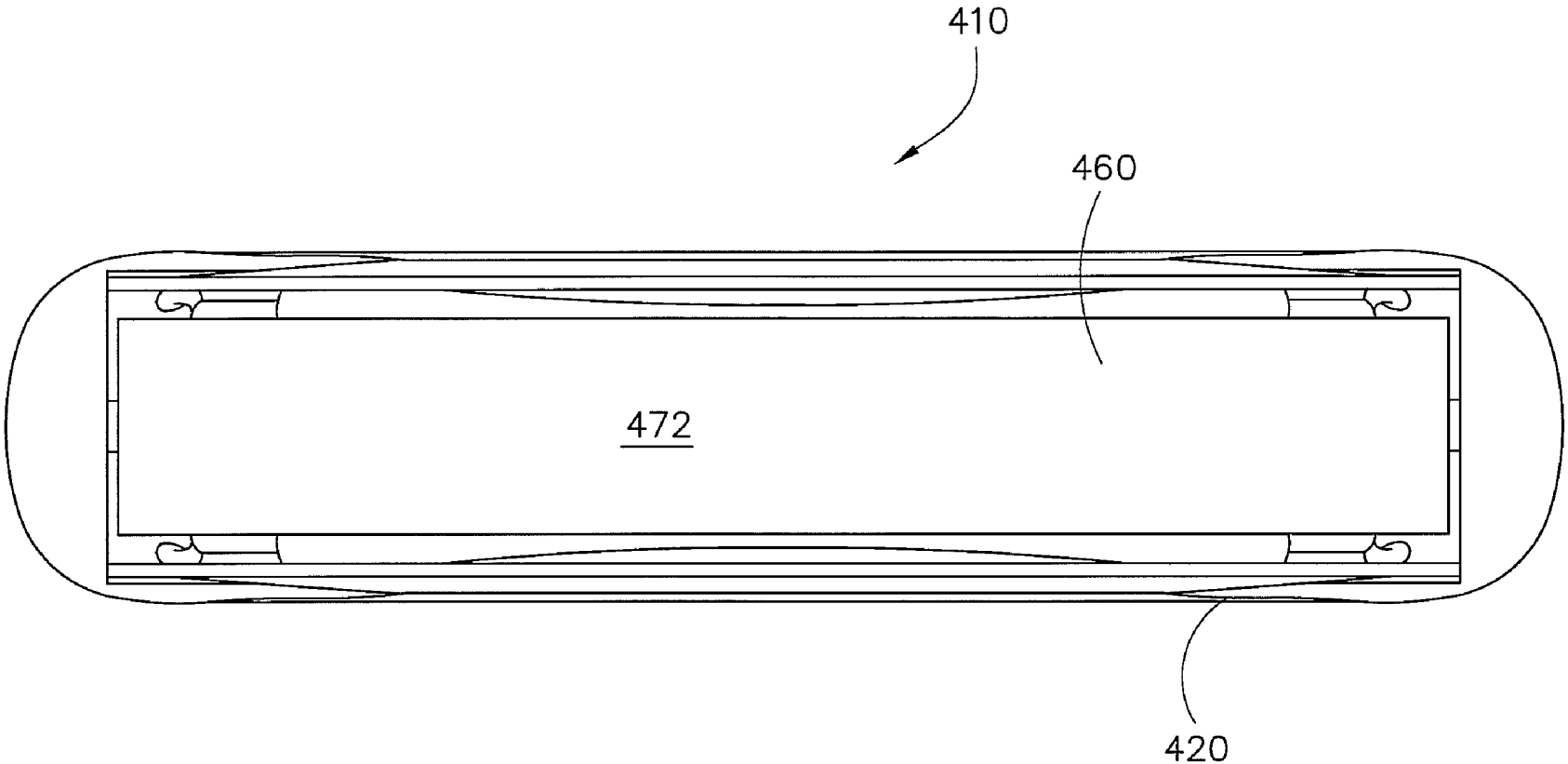
FIG. 28 is a bottom plan view of the device of FIG. 26 with the roller in place.
Figure 29:
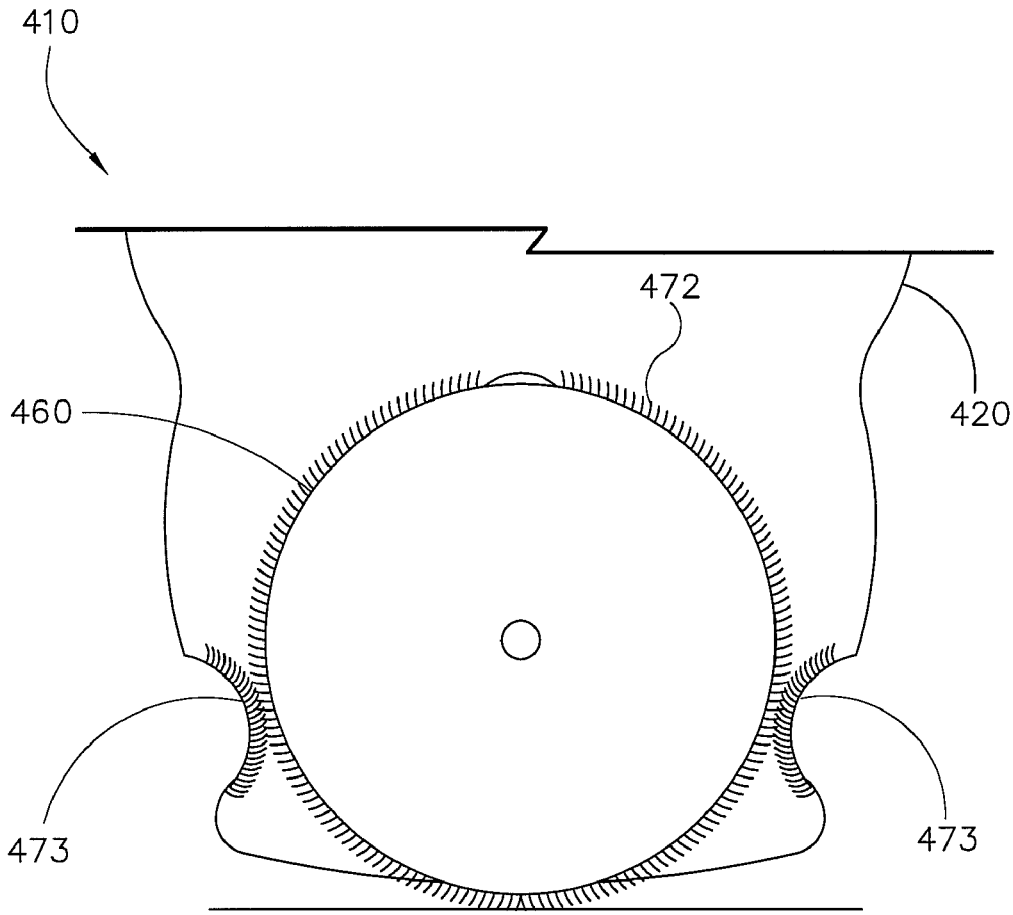
FIG. 29 is a cutaway type view of the device of FIG. 26 focusing on the roller arrangement.

FIG. 25B shows the bottom of the device 310 with scallop cuts 381 in the fabric 372 and the mating bosses 383 on the rollers 360, 361. In other embodiments, these scallop cuts 381 are not necessary as the fabric would just be cut into rectangles and folded over both edges of the roller, not just the one. In another embodiment, e.g., FIG. 23B, the mating bosses 383 may be located on the inside concave portion of the rollers 360, 361.

FIGS. 26-29 show yet another embodiment. This embodiment of device 410 has a single main roller 460 mounted in a semi circular housing 420. The main roller 460 attracts and picks up hair, while internally two small sections of directional material 473 attached to the housing 420 shed the hair from the main roller 460. This leaves the hair trapped inside the housing. The main roller 460 only rotates about 90 degrees in both directions. A stop locks the main roller 460 at a specific point to pick up hair, then when rolled in the reverse direction the roller 460 will almost roll 180 degrees which brings the hair up into the housing 420. The roller 460 locks again. The motion is repeated until the housing 420 is full. The process picks up hair because the directional material is opposing one another. The velour 473 attached to the housing 420 "lays" down while the velour 472 on the large roller 460 brings in hair. When the device 410 reverses direction, the hair on the large roller 460 will pass the same small strip of velour 473 but now the velour 472 on the large roller 460 will "lay" down and the smaller strip of velour 473 traps the hair inside the housing 420.

As mentioned, various components of the device can be attached by sonic heat staking or hot melt glue. The heat staking process may have a feature that shows orientation for future troubleshooting The velour cleaning material may be applied to the rollers as a sort of label, that is, with one side having an adhesive and one side having a unidirectional fabric. Alternatively, the cleaning fabric may include a properly cut and sized piece of material hot glued to the roller. The fabric may have semi circular tabs cut out to align with corresponding structures on the rollers. This makes it easier to fit the fabric to the roller during assembly. While the cleaning material is typically red velour, blue and other, lighter colors such as white and yellow may be used. For example, the lighter colors may be beneficial as they will better show dirt and debris.

The cleaning fabric preferably has some cushion. The cushion density makes a difference in exerted force. The velour wears out after time, for example, 6 hours to 8 hours of use.

In one embodiment, the roller fasteners may consist of de-nest lugs embedded in the top housing. In such an embodiment, the roller removal force is about 16 pounds.

The device is preferably made of transparent 100% recyclable R-PET or some other suitable plastic resin.

In another embodiment, the inside of the device is sprayed with glue or some other adhesive. This feature attracts and holds the debris to the inner walls of the device. This feature will promote the fact that the device is disposable.

The invention may further includes a process for manufacturing a device assembly that requires a rigid part (e.g., a roller) to have a dissimilar, in this case a cleaning fabric, material bonded to it. This process is preferably as follows:

1. The cleaning fabric is provided in manufactured rolls;

2. A width of fabric is coated on the backside with a heat activated adhesive (e.g., "hot melt" glue);

3. The now adhesive coated fabric is allowed to cool (e.g., a few seconds);

4. The cooled adhesive coated fabric is cut to final shape;

5. The cut adhesive coated fabric is reheated to activate glue immediately prior to assembly to the rigid roller part (note that the heat is preferably provided in the form of radiant, convection, microwave, etc. and/or provided by fabric carrier, or the rigid part is heated); and 6. The rigid part is then presented to the heated, cut, adhesive coated fabric to produce the roller assembly.

One advantage of this process is that a machine for manufacturing and assembling the roller and fabric allows for ease of placement of the fabric onto and over the edges of the rigid part This machine that allows for fabric to be assembled onto a rigid part's surface and allows for the fabric to be rolled over the edges of the rigid part, all in a single operation. The machine is well suited to either manual hand assembly or high-speed automation and has the following attributes:

1. Ability to apply adhesive to full roll at high speed, vs. individual pieces

2. Ability to apply adhesive at any time, vs. immediately before assembly onto rollers 3. Prevents the edges of the fabric from fraying The basic operation of the machine is as follows:

1. Placing of fabric onto fabric carrier.

a. The fabric is located on the carrier with the assistance of the "Fabric Stops."

b. The fabric is supported initially by the "Fabric Springs," although these may be unnecessary if the fabric is otherwise adequately located directly into the "Part Cradle."

c. The fabric has some type of adhesive already applied to it, or else the adhesive is applied after the fabric is located into the carrier. If a non-adhesive attachment method is used (i.e. ultrasonic), then the fabric does not have any adhesive on it.

d. If the fabric is coated with a heat activated adhesive, the heat to activate the adhesive is applied after the adhesive-coated fabric is placed into this carrier (easier to handle cold), but directly before the next step. The carrier passes through a conveyor type heat source, or else the carrier, or roller parts itself is heated.

2. Rigid Part (e.g., the roller) is placed onto part holder a. This could either be a hand operation or an automated feeder system b. Retention of the rigid part in the holder could be accomplished through a number of means, such as vacuum, sprung retention clips, friction, suction cups, adhesive, etc.

3. The fabric carrier, with the loaded fabric, moves into position under the part holder a. It could also be possible that the fabric carrier is fixed under the part holder and the fabric is sequentially fed onto it.

4. Downward pressure is applied to the "Pusher," compressing the "Holder Springs"

a. This causes the Part loaded in the Part Holder to press against the fabric, depressing the Fabric Springs, and ultimately seating the part against the fabric, formed by the Part Cradle.

b. Sandwiching the fabric between the part and the Part Cradle causes the ends of the fabric to raise up from their resting position, key to allowing the Roll-Over roller to get underneath it.

c. The Fabric Springs eventually compress below the surface of the Part Cradle, due to their location in recessed holes.

d. The pressure could either be provided manually or through automated methods.

5. Continued downward pressure on the Pusher compresses the "Pusher Springs"

a. It is key here that the Pusher springs are harder to compress (higher K value) than the Holder Springs, so that the Part Holder loaded with the Part is compressed fully into the fabric and Cradle, and then the Pusher springs begin to compress. This produces in effect a two-stage action, first compressing the Pusher Springs and then compressing the Holder Springs.

6. As the Pusher springs continue to be compressed, the Roll-Over Roller begins to contact the Roll-Over Ramp a. As the Roll-Over Roller is forced onto the Roll-Over Ramp, the Roll-Over Springs begin to bend sideways, providing constant pressure between the Roll-Over Roller and the Roll-Over Ramp.

b. The constant pressure is important to allow the Roll-Over Roller to get underneath the fabric to initiate the rollover process c. The constant pressure could be provided by any number of means besides the springs, such as spring wire, spring metal sheet stock, rotational springs, polymer springs, etc d. The Roll-Over Roller may not necessarily need to be a roller. It could perhaps be a thin fixed part, such as a rigid wire, a wedge shape, etc, anything that could get underneath the fabric, travel down the ramp, and transfer adequate pressure across its width e. The roll over operation could be on both sides, not just one, by mirroring the Roll-Over Rollers, Roll-Over Springs, Roll-Over Ramp, and Part Holder Cutout 7. The Roll-Over Roller forces the fabric to roll over the edge of the part and seat against the inside of the part a. The cut out in the part holder allows room for the Roll-Over Roller to travel inside the part b. The roll-over action provides the desirable benefit of applying pressure across the entire application surface of the fabric, including on the edge of the rigid part.

8. The pressure on the pusher is now released and the holder springs force the machine back to its original state.

a. The part is released from the Part Holder.

9. The now combined rigid part with its fabric surface and rolled edges is complete a. The Fabric Springs force the assembly back up, out of the Cradle for transport or removal In the preferred embodiment described herein, the rollers fit into the device only one way. Further, although a two roller and single roller version are shown, 3 or more smaller rollers may used. The device may also have dust pan feature for catching and hold the debris within the housing.

In another preferred embodiment, the invention is a cleaning kit comprising: a fabric cleaning and/or sweeping device and instructions on its use. The kit may be sold separately via promotional materials, advertising and/or with instructions in each kit being used to explain the benefits of using the various products together. Promotional materials are defined in U.S. Pat. No. 6,777,064. which is incorporated herein by reference.

The promotional materials, instructions and other consumer-related information may be communicated to the consumer via traditional printed methods or alternative methods including, but not limited to, multimedia presentations on CD-ROMs or DVDs included with the packaging, accessed via the internet by entering or scanning the product's UPC or trade name into an internet browser, by reading an imbedded RFID tag located within the cleaning implement with an internet-enabled device, or through some other suitable electronic means. In this respect, a mutually beneficial interface between the user and the consumer goods provider may be created further strengthening customer loyalty.

Various other features, embodiments and advantages of the present invention are contemplated as being within the scope of the following claims particularly pointing out and distinctly claiming the subject matter regarded as the invention.

I hereby claim:

1. A fabric cleaning device comprising:

a housing having a bottom portion and a handle portion;

a first semi-cylindrical roller movably secured within the bottom portion to extend at least partially out of the housing and having a debris removing surface;

a second semi-cylindrical roller operably associated with the first roller and having a debris removing surface that contacts the debris removing surface of the first roller;

a first pair of stops formed on the bottom portion and spaced from one another along a central axis of the first roller configured to prevent rotation of the first roller past the first pair of stops; and a second pair of stops formed on the bottom portion and spaced from one another along a central axis of the second roller configured to prevent rotation of the second roller past the second pair of stops.

2. The device of claim 1, further comprising a plurality of ribs disposed on one of the handle portion and the bottom portion configured to help align the handle portion and bottom portion during assembly.

3. The device of claim 2, wherein the rollers have axles with locks located on each end of the roller axles to lock the roller in place to prevent their removal.

4. The device of claim 2, wherein at least one of the rollers has an extended edge to engage the opposing roller sooner.

5. The device of claim 1, wherein the rollers have different sized axles that are received into corresponding different sized holes in the bottom portion to prevent misassembly during the production process.

6. The device of claim 1, wherein the bottom portion includes living hinges that allow for ease of installing the rollers.

7. The device of claim 1, wherein the first pair of stops prevents rotation of the first roller by selectively engaging either an inner side or outer side of the first roller depending upon the direction of rotation of the first roller, and wherein the second pair of stops prevents rotation of the second roller by selectively engaging either an inner side or outer side of the second roller depending upon the direction of rotation of the second roller.

8. The device of claim 1, wherein at least one of the rollers is configured to put the initial contact with debris to be picked up closer to a clean-off zone on the other roller.

9. The fabric cleaning device of claim 1, wherein the first pair of stops and the second pair of stops each includes a beveled edge and wherein the beveled edges of the first pair of stops and the second pair of stops are engaged by the first semi-cylindrical roller and the second semi-cylindrical roller respectively to prevent rotation of the first semi-cylindrical roller and the second semi-cylindrical roller.

10. The fabric cleaning device of claim 1, further comprising a protrusion positioned adjacent to each of the stops of the first pair of stops and the second pair of stops and at least one rib positioned between pairs of protrusions and each of the stops to increase stability and to provide a point of engagement between the handle portion and the bottom portion.

11. A fabric cleaning device comprising:

a housing having a bottom portion, a handle portion, a first side, a second side opposite the first side, a first end, and a second end opposite the first end;

a first debris removing surface movably secured within the bottom portion between the ends to extend at least partially out of the housing;

a second debris removing surface movably secured within the bottom portion between the ends to extend at least partially out of the housing;

a first pair of stops formed on the bottom portion and spaced from one another along an axis defined by the first side and extending inwardly relative to the first side of the housing that prevents rotation of the first debris removing surface in a first direction;

a second pair of stops formed on the bottom portion and spaced from one another along an axis defined by the second side and extending inwardly relative to the second side of the housing that prevents rotation of the second debris moving surface in a second direction; and wherein the first pair of stops and the second pair of stops include a beveled edge with which the first debris removing surface and the second debris removing surface come into contact so as to prevent rotation thereof.

12. The fabric cleaning device of claim 11, wherein the first debris removing surface is located on a first semi-cylindrical roller and wherein the second debris removing surface is on a second semi-cylindrical roller.

13. The fabric cleaning device of claim 12, wherein the first pair of stops prevents rotation of the first semi-cylindrical roller by selectively engaging an inner side or an outer side of the first semi-cylindrical roller depending on the direction of rotation of the first semi-cylindrical roller.

14. The fabric cleaning device of claim 13, wherein the second pair of stops prevents rotation of the second semi-cylindrical roller by selectively engaging an inner side or an outer side of the second semi-cylindrical roller depending on the direction of rotation of the second semi-cylindrical roller.

15. The fabric cleaning device of claim 11, further comprising a plurality of ribs disposed on one of the bottom portion and the handle portion and configured to enable aligning of the bottom portion with respect to the handle portion.

16. A fabric cleaning device having a first side, a second side opposite the first side, a first end and a second end opposite the first end, the fabric cleaning device comprising:

a housing having a bottom portion and a handle portion;

a first debris removing surface movably secured within the bottom portion between the ends and including a unidirectional cleaning material;

a second debris removing surface movably secured within the bottom portion between the ends and including a unidirectional cleaning material;

a first pair of stops formed on the bottom portion and disposed along the first side of the fabric cleaning device and configured to prevents rotation of the first debris removing surface in a first direction; and a second pair of stops formed on the bottom portion and disposed along the second side of the fabric cleaning device and configured to prevents rotation of the second debris removing surface in a second direction that is opposite the first direction.

17. The fabric cleaning device of claim 16, wherein the first debris removing surface is located on a first semi-cylindrical roller and wherein the second debris removing surface is on a second semi-cylindrical roller.

18. The fabric cleaning device of claim 17, wherein the first pair of stops prevents rotation of the first semi-cylindrical roller by selectively engaging an inner side or an outer side of the first semi-cylindrical roller depending on the direction of rotation of the first semi-cylindrical roller, and wherein the second pair of stops prevents rotation of the second semi-cylindrical roller by selectively engaging an inner side or an outer side of the second semi-cylindrical roller depending on the direction of rotation of the second semi-cylindrical roller.

19. The fabric cleaning device of claim 18, wherein the cleaning material of the first cleaning surface engages the debris removing material of the second debris removing surface.

20. The fabric cleaning device of claim 16, further comprising a pair of debris diverting edges that respectively engage the first and second cleaning surfaces.

* * * * *

UNITED STATES PATENT AND TRADEMARK OFFICE
Certificate

Patent No. 8,011,050 B2 Patented: September 6, 2011

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jeremy F. Knopow, Burlington, WI (US); and Matthew N. Thurin, Wauwatosa, WI (US).

Signed and Sealed this Thirteenth Day of May 2014.

MONICA S. CARTER
*Supervisory Patent Examiner*
Art Unit 3727
Technology Center 3700